US006578928B1

(12) United States Patent
Romagnoli et al.

(10) Patent No.: US 6,578,928 B1
(45) Date of Patent: Jun. 17, 2003

(54) SYSTEM AND CORRESPONDING AUTOMATIC MACHINE FOR ASSEMBLING AND SHAPING CIRCULAR BRUSHES

(75) Inventors: Marino Romagnoli, San Lazzaro di Savena (IT); Raffaele Nadalini, Casalecchio di Reno (IT)

(73) Assignee: Unimac S.R.L., Zola Predosa (IT)

( * ) Notice: Subject to any disclaimer, the term of this patent is extended or adjusted under 35 U.S.C. 154(b) by 0 days.

(21) Appl. No.: 09/537,832

(22) Filed: Mar. 29, 2000

(30) Foreign Application Priority Data

Apr. 16, 1999 (IT) ..... BO99A0176

(51) Int. Cl.[7] ..... A46D 3/04; A46D 3/00

(52) U.S. Cl. ..... 300/2; 300/21

(58) Field of Search ..... 300/21, 2; 15/180, 15/179, 181

(56) References Cited

U.S. PATENT DOCUMENTS 1,818,087 A * 8/1931 Nielsen ..... 300/2
2,108,742 A * 2/1938 Bickel ..... 300/21
2,288,337 A * 6/1942 Whittle ..... 300/21
2,525,947 A * 10/1950 Rose ..... 15/181
2,607,630 A 8/1952 Le Lebvre
2,658,802 A * 11/1953 Stahel ..... 15/181
3,106,739 A * 10/1963 Less ..... 15/180
3,253,291 A * 5/1966 Nelson ..... 15/181
3,304,568 A * 2/1967 Nelson ..... 300/21
3,335,444 A * 8/1967 Weiler ..... 15/179
3,839,763 A 10/1974 Gould

FOREIGN PATENT DOCUMENTS

GB 637 322 A 6/1939

* cited by examiner

*Primary Examiner*—Gary K Graham
(74) *Attorney, Agent, or Firm*—Herbert Dubno

(57) ABSTRACT

A system for assembling and shaping semi-finished products (4) consisting of circular brushes comprises a bristle-insertion station (ST2) in which, substantially: a) there is provided a folded circular ring nut (107), which extends axially along its own axis (7*x*), and has a conical front profiled section (7*ap*), a central cylindrical portion (7*a*), a rear circumferential side (7*dp*) and a central axial hole (7*b*), fitted onto a ring nut-holder unit (43-39-38) with a conical front head (43); b) a ring (2) is disposed slightly spaced axially in front of the said ring nut (107) and coaxially (2*x*–7*x*) relative to the said folded ring nut (107); and c) a plurality of bristles (61) is inserted in a circumferentially distributed manner, by being made to pass between the inner circumference of the said ring (2) and the outer circumference of the said head (43), and thus on the outer circumference of the said ring nut (107), until a specific length (98*a*) of bristles (61) is obtained, disposed downstream from the said ring (2). A machine for implementation of this system.

18 Claims, 18 Drawing Sheets

29
25
27
11
26
7
9b
10
6
2
8a
57b
57a
8b
54
55
76b
76a
78
77
62b
62c
62a
74
91b
91a
75
95
97b
97c
97a
95b
95a
83
81
24
84
85
89
90
65
23
70
22
14b
12b
12a
14a
13
50
45
48b
48a
5
21
43
39
38
31
9
30
1A
9a
20
35a
35b
36
37
42
2
8c
32,33
38
39c
39d
39a
44a
43
44b
44c
39b 38
58b
58a
40
39a
56d
56c
39b
56b
43
56a
5x 7d
7b
7x
9b
7a
9a 60d
60c
60b
47b
47a
60a
45

12a
2x
2
12b 29
37
5x
42
25
28
26
27
F1
25
41a
20
34
32
35b
36
30
25
30
31
31
41
33
59a
38
59b
40
39
2B
2x
7
9b
9a
2C
2D
46
45
45a
2E
5x
14b 29
28
26
27
25
25
25
32
30
30
31
31
33
37
42
5x
F1
20
34
35b
36
41
59a
59b
38
40
39
7
3B
47a
47b
14a
14b
12a
12b
3C
38
38
39
7
43
12a
2
12b 29
28
26
27
25
25
32
25
30
30
31
31
33
59b
47b
ST1
14b
12b
4B
12a
22
14a
21
39
7
47a
4A
40
38
41
59a
34
36
35b
20
60a
56b
56a
43
39
7ap
47a
7
38
7dp
5x
56c
56d
60d
47b
60c
60b
37
42
5x
2
12b
12a 38
107
39
5x
38
2
43

70
Ta
Tb
65
60a
60b 68
67a
67b
82a
81
82b
60a
60b
20
21
47a
47b
45
45a
5A
ST2
22
14a
14b
23
5B
5x
74
27
5C
91b
75
24
91a
80
97a
97b 38
5x
7ap
7bp
61z
107
7ap
61y
61k
61z
2
70
70c
43
Fk
70c 67a
68
67b
81
82a
82b
60a
60b
20
21
6A
22
70
23
5x
6B
24
60a
74
91b
60b
91a
80

107
38
39
5x
38
98a
70
70c
43
2
21

67a
68
67b
82a
81
82b
60a
60b
20
7A
22
23
5x
7B
24
60a
60b
91b
91a
74
80

38
39
5x
38
107
2
70
70c
43

67a
68
67b
82a
81
82b
60a
60b
20
21
8A
22
23
5x
8B
24
60a
91b
60b
91a
80
74
25

38
39
5x
38
107
12a
2
70
70c
43

67a
68
82a
60a
67b
81
82b
60b
20
21
22
9A
23
5x
24
9B
60a
60b
91b
91a
80
74
25

61a
61b
61c
98a
98b
38
107
5x
20
2
21
22
23
10A
71a
71b
70
Ta
Tb
64a
64b
65
63a
63b
60a
60b
99
66a
66b
67a
67b
68
81
82a
82b
83
84
85
88
89
90
24
10B
79
91a
91b
80
95a
95b
97a
97b
94
75
27
74
F2

61
12a
2
39a
38
107
41
5x
38
1c
1c
40
43
39b
70
71a
64a
65
71b
64b
24
67a
66a
66b
68
81
82a
60a
83
67b
81
82b
60b
41
20
31
21
22
11A
23
65
5x
11B
25
70
74
91b
79
91a
80
75
94
27

61
1d
107
5x
43
4
1c
1c
70
65

67a
66a
66b
68
81
82a
60a
83
67b
81
82b
60b
41
20
31
21
22
23
12A
24
12B
5x
25
70
74
91b
79
91a
80
75
94
27

SYSTEM AND CORRESPONDING AUTOMATIC MACHINE FOR ASSEMBLING AND SHAPING CIRCULAR BRUSHES

SPECIFICATION

1. Field of the Invention

The present invention relates to a method of and to an automatic machine for assembling and shaping circular brushes.

More particularly, the present invention is included in the specific field of systems and corresponding automatic machines for assembling the components of circular brushes, in order to shape a circular brush semi-finished product, in which each semi-finished product obtained comprises substantially: a circular finished ring nut, which extends axially along its own axis, and has a first circumferential side, a substantially cylindrical central portion, a second circumferential side, and a central axial hole, in which the said two sides form a circumferential channel in the shape of a "U"; a ring, which extends axially along its own axis, and is disposed between the said two circumferential sides of the said finished ring nut, with its own axis disposed coaxially relative to the axis of the finished ring nut; and a plurality of bristles, which are distributed circumferentially and project radially towards the exterior, and are disposed in the shape of a "V", with the vertex inside the said "U"-shaped channel, and with the ring disposed in the vicinity of the convex angle of the "V" itself, which is formed by the said bristles.

2. Background of the Invention

At present, in order to assemble the components of a brush, semi-automatic machines of various types are used, in which, during assembly, external intervention is required by an operator, who must position manually the various components which are designed to shape the semi-finished circular brush, or by semi-automatic and/or automatic machines, in which multiple operations are required.

This known art has a series of disadvantages.

A first disadvantage is that the presence of an operator gives rise to a corresponding expense which increases the production costs of the corresponding circular brush.

A second disadvantage is that the multiple operations require a lengthy operating time, with a consequent low production capacity in terms of time, and the adoption of complex, costly machines.

A third disadvantage is that assembly of the bristles is particularly complicated, involves a plurality of operations, and leads to malfunctioning.

A fourth disadvantage is owing to the fact that the length of some bristles in the semi-finished circular brush obtained can be incorrect.

OBJECT OF THE INVENTION

The object of the present invention is to eliminate the above-described disadvantages.

SUMMARY OF THE INVENTION

The invention solves the problem of creating a system for assembling and shaping circular brush semi-finished products along an assembly line which extends along its own axis, in which each semi-finished product comprises: a circular finished ring nut, which extends axially along its own axis, and has a first circumferential side, a substantially cylindrical central portion, a second circumferential side, and a central axial hole, wherein the said two circumferential sides form a circumferential channel in the shape of a "U"; a ring, which extends axially along its own axis, and is disposed between the said two sides of the said finished ring nut, with its own axis disposed coaxially relative to the axis of the finished ring nut; and a plurality of bristles, which are distributed circumferentially and project radially towards the exterior, and are disposed in the shape of a "V", with the vertex inside the said "U"-shaped channel, and with the ring disposed in the vicinity of the convex angle of the "V" itself, which is formed by the said bristles.

According to the invention a bristle insertion station is provided in which a)-there is provided a folded circular ring nut, which extends axially along its own axis, and has a conical front profiled section which diverges towards the rear, a central cylindrical portion, an inclined rear circumferential side which diverges towards the rear, and a central axial hole, fitted onto a ring nut-holder unit with a conical front head, the axis of the said coaxial ring nut being disposed coaxially relative to the axis of the said assembly-shaping line; b)-the said ring is disposed slightly spaced axially in front of the said folded ring nut, the axis of the said ring being disposed coaxially relative to the axis of the said assembly-shaping line, and thus coaxially relative to the axis of the said folded circular ring nut; and c)-a plurality of bristles is inserted in a circumferentially distributed manner, by being made to pass between the inner circumference of the said ring and the outer circumference of the said head, and thus on the outer circumference of the said folded circular ring nut, until a specific length of bristles is obtained, disposed downstream from the said ring.

The invention also comprises a machine for implementing the method, and which comprises an assembly-shaping line which extends axially along its own axis, and includes: a translator-shaft unit, which is mobile axially by command, and can support and translate axially along the said axis of the said assembly-shaping line a ring nut-holder unit, which, going from the front towards the rear, has a conical head, a radial spreader device, and a shaft; a folder-ring nut unit, which is provided with a circular matrix, which extends axially along its own axis, coaxially relative to the axis of the said assembly-shaping line, and can fold an unfinished circular ring nut in order to obtain a conical profiled section which diverges towards the rear in the vicinity of its front head, and an inclined profiled section which also diverges towards the rear of the circumferential side; a ring-holder unit which is designed to hold in position a ring which has its corresponding axis coaxial relative to the axis of the said line; a bristle-cutter unit, which is mobile axially by command, and is designed to cut a plurality of continuous tufts of bristles which are disposed upstream from the said ring, and a bristle-gripper unit, which is mobile axially by command, and is designed to move the said bristles axially relative to the said ring.

BRIEF DESCRIPTION OF THE DRAWING

The invention is described in detail with reference to the attached drawings, in which.

SPECIFIC DESCRIPTION

Figure 16:
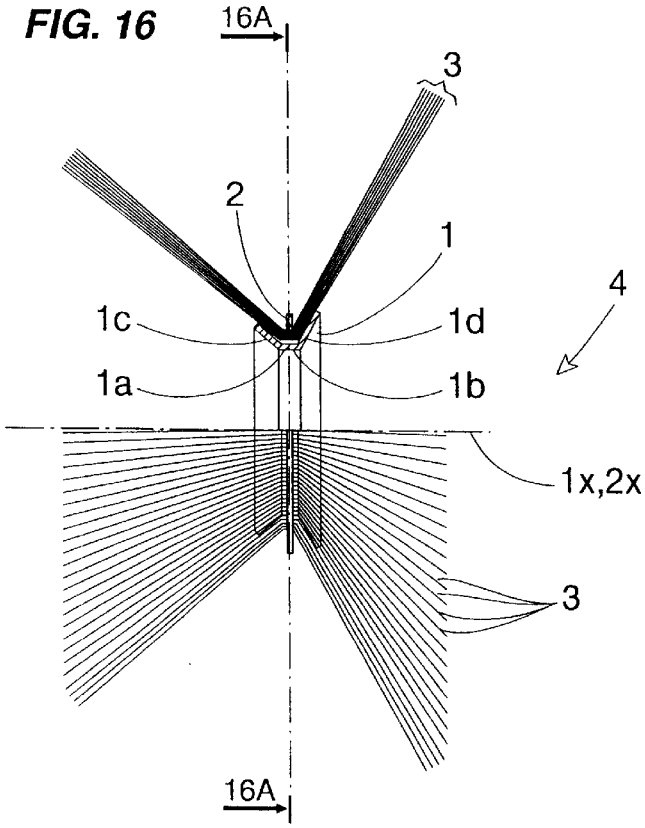
FIGS. 16 and 16A are respectively a lateral schematic view partially in cross-section, and a view in cross-section along the line 16A—16A in FIG. 16, of the circular brush semi-finished product obtained by means of the method and the machine which are the object of the present invention.
Figure 16A:
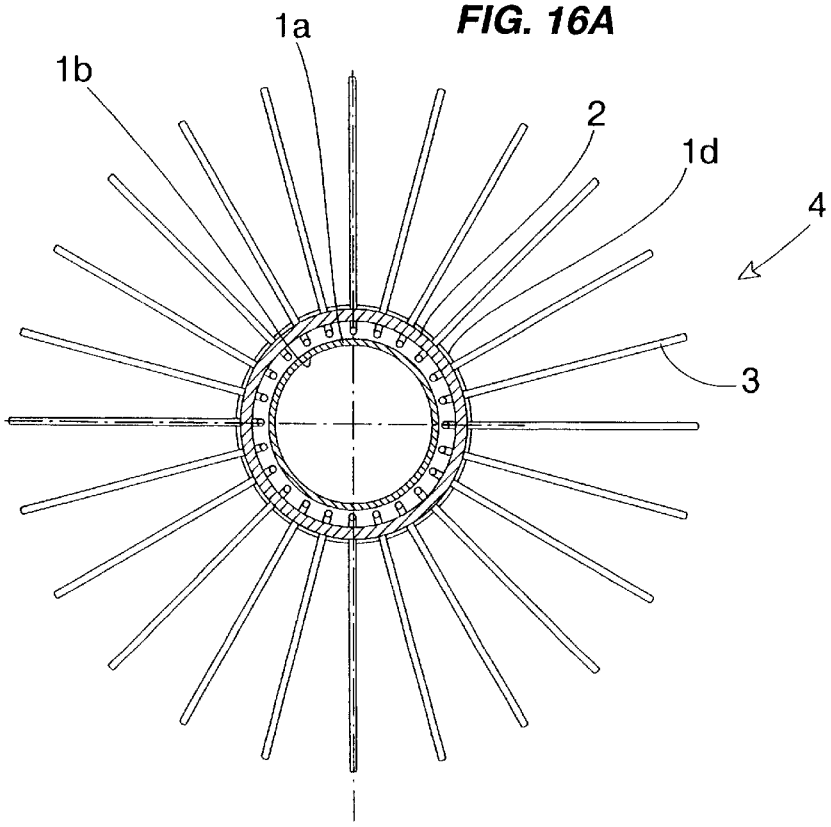

With reference to the following description, the operative method and the corresponding automatic assembly-shaping machine, which are both the object of the present invention, are designed to obtain, one after another, circular brush semi-finished products wherein, see FIGS. 16 and 16A, each semi-finished product obtained, which in this case is indicated as 4, substantially comprises: a circular finished ring nut 1, which extends axially along its own axis 1*x*, and has a first circumferential side 1*c*, a substantially cylindrical central portion 1*a*, a second circumferential side 1*d*, and a central axial hole 1*b*, in which the said two circumferential sides 1*c* and 1*d* form a circumferential channel in the shape of a "U"; a ring 2, which extends axially along its own axis 2*x*, and is disposed between the said two circumferential sides 1*c* and 1*d* of the said finished ring nut 1, with its own axis 2*x* disposed coaxially relative to the axis 1*x* of the finished ring nut 1; and a plurality of bristles 3, which are distributed circumferentially and project radially towards the exterior, and are disposed in the shape of a "V", with the vertex inside the said "U"-shaped channel, and with the ring 2 disposed in the vicinity of the convex angle of the "V" itself, which is formed by the said bristles 3.

Figures 1, 1A:
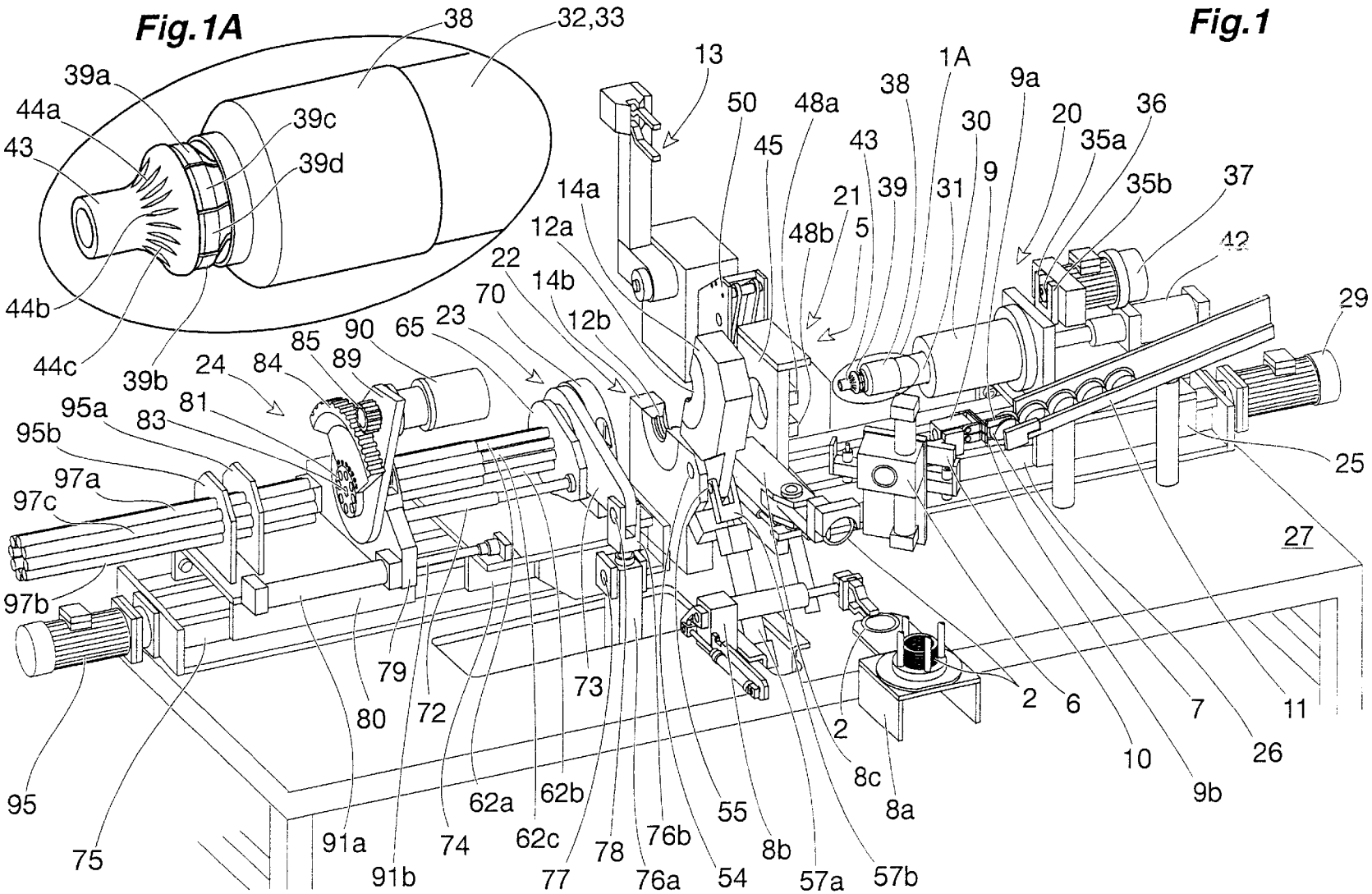
FIG. 1 is a schematic perspective view of the assembly-shaping machine.
FIG. 1A is a perspective view of the detail 1A in FIG. 1.
Figure 1C:
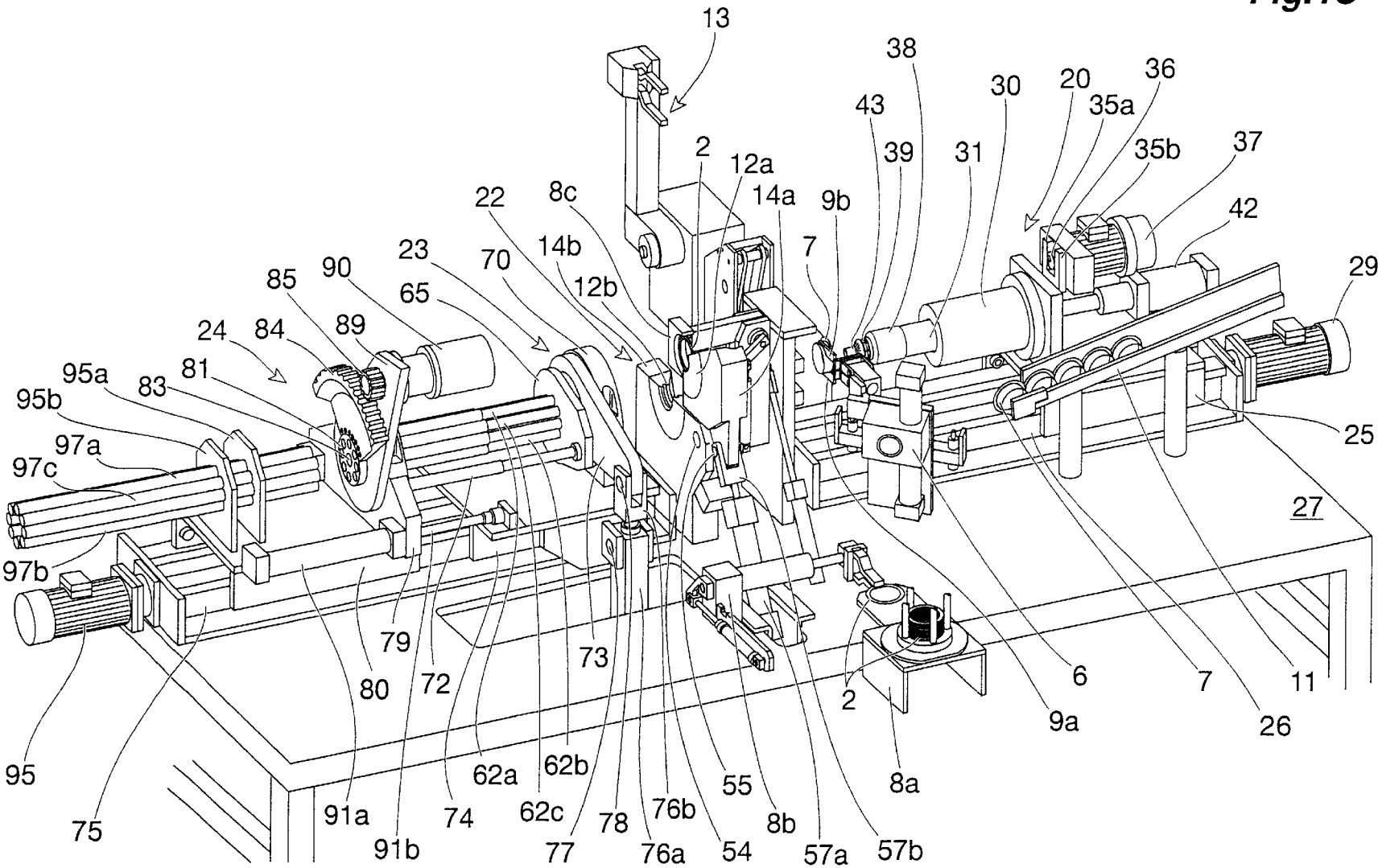
FIG. 1C is a general schematic perspective view of the machine during the loading operations.
Figure 2:
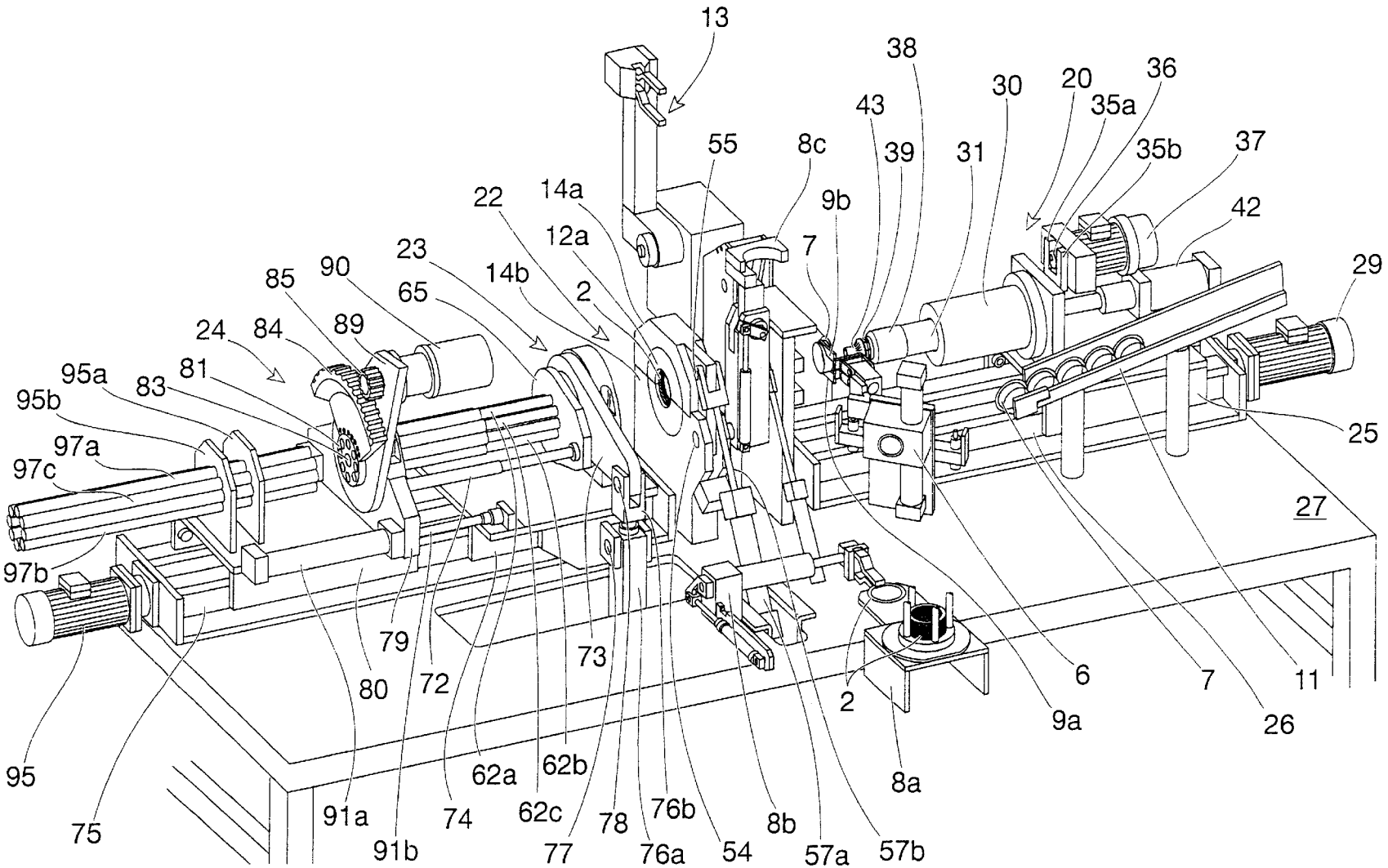
FIG. 2 is a general schematic perspective view of the machine at the end of the loading operations.
Figures 2A, 2B, 2C, 2D, 2E:
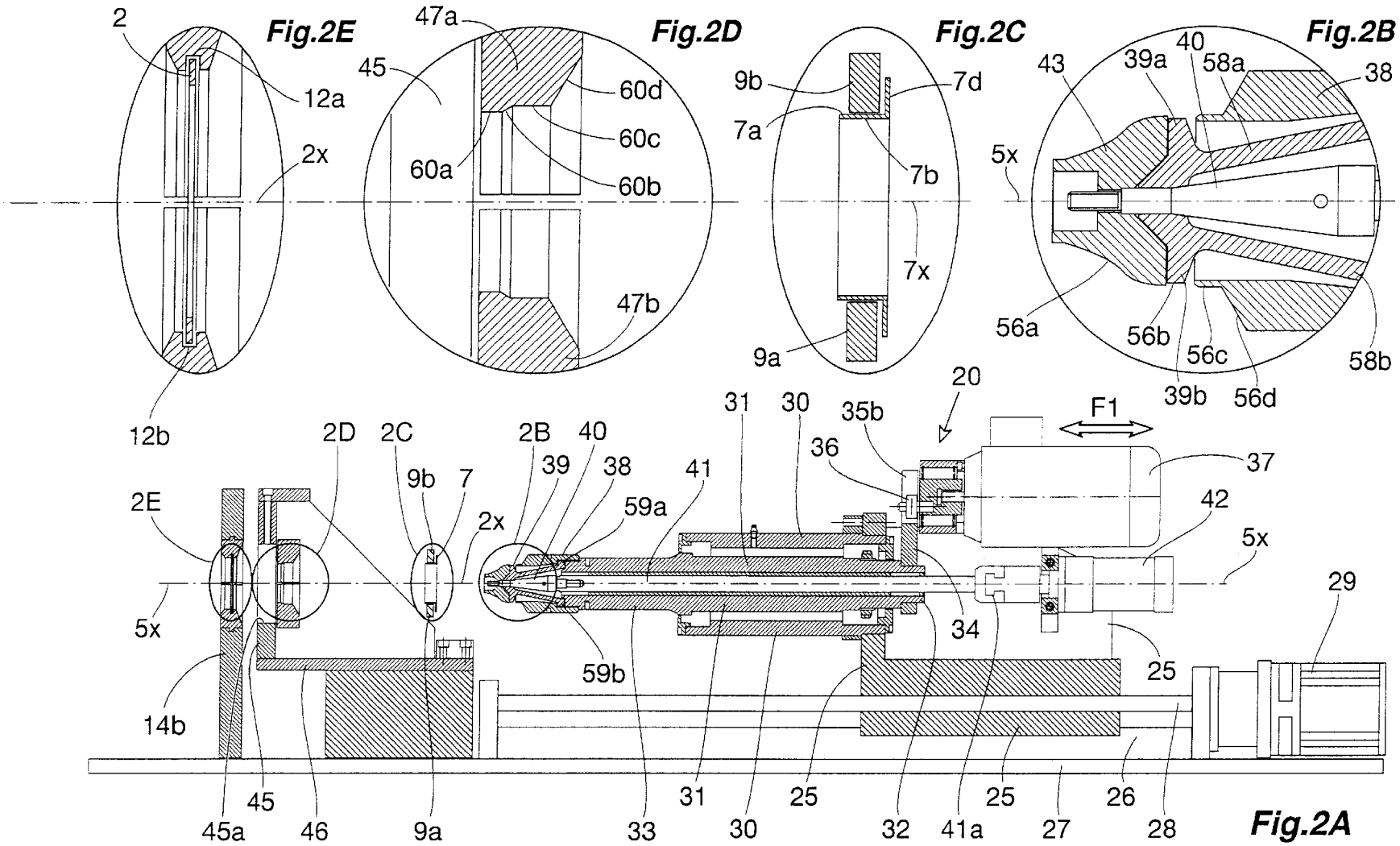
FIG. 2A is a lateral schematic view in cross-section, relative to a longitudinal-vertical plane of the machine in FIG. 2.
FIGS. 2B, 2C, 2D and 2E are respectively enlarged illustrations of the details 2B, 2C, 2D and 2E in FIG. 2A.

With reference to FIGS. 1, 1C, 2 and 2A, the assembly-shaping machine extends longitudinally, and has centrally an assembly-shaping operative line indicated as 5 as a whole, which is described in greater detail hereinafter, and is designed to assemble and shape the said circular brushes 4, and is such that the said assembly-shaping line 5 extends along its own longitudinal axis, which is indicated as 5*x* in FIG. 2A and in the subsequent lateral views.

On a first side of the said assembly-shaping line 5, there are disposed first supply means, indicated as 6 as a whole, which are designed to supply one after another unfinished circular ring nuts indicated as 7, which, see also FIG. 2C, extend axially along their own axis 7*x*, and, substantially, have a cylindrical front portion 7*a*, a rear circumferential side 7*d* which is oriented at 90° relative to the said axis 7*x*, and a central axial hole 7*b*.

Again on the said first side, but in a position which is further forwards, there are disposed second supply means with several elements, indicated as 8*a*–8*b*–8*c*, which are designed to supply one after another the rings 2, which, see FIG. 2E, extend axially along their own axis 2*x*.

The first ring nut supply means 6, see FIG. 1, substantially comprise a gripper 9 with tines 9*a* and 9*b*, which is supported by an articulated, rotary mechanical cuff 10, such that the said gripper 9 collects the unfinished ring nuts 7 individually in succession, in the vicinity of the downstream end of a hopper 11, and then translates them positively towards, and into, the assembly-shaping line 5, see also FIGS. 1C, 2 and 2A, and then keeps them in position inside the said assembly-shaping line 5, by disposing the axis 7*x* of the unfinished circular ring nut 7 coaxially relative to the axis 5*x* of the assembly-shaping line 5, see FIG. 2C.

The second supply means 8*a*–8*b*–8*c* substantially comprise: a store 8*a*, which is designed to contain stacked vertically a plurality of rings 2, and to collect and present individual rings 2 in succession, by extracting the latter individually from the base of the stack; a translator 8*b,* which is designed to grasp the rings 2 presented by the store 8*a,* and then to translate them; and an articulated positioner 8*c,* which is designed to grasp the rings 2 presented by the said translator 8*b* and position them inside a recess 12*a* in an upper shell 14*a* of a ring support 22.

Figure 13:
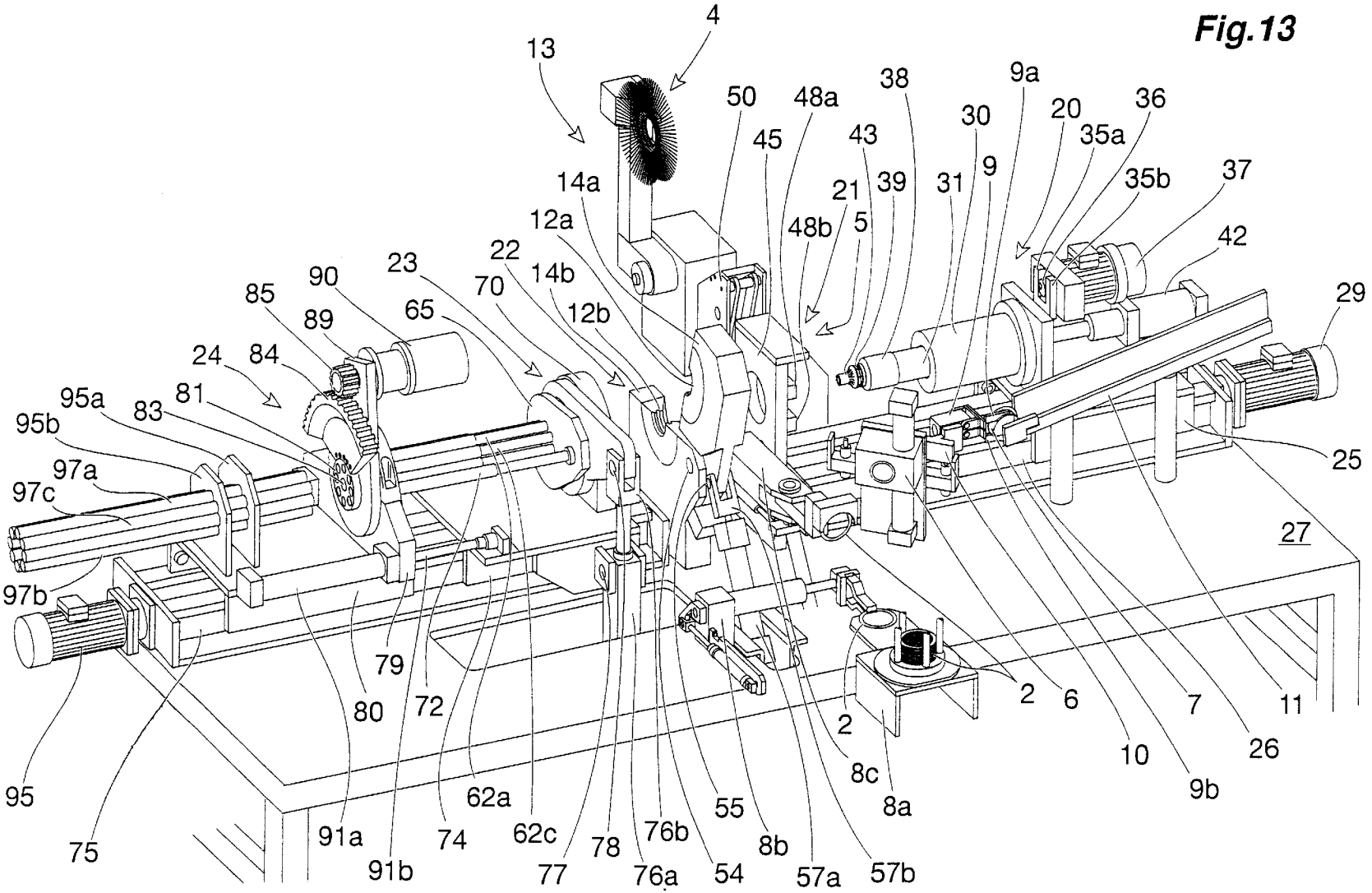
FIG. 13 is a schematic perspective view of the shaping machine during unloading of the circular brush semi-finished product obtained.

On the other side of the assembly-shaping line 5, i.e. on the second side, there are disposed collection-removal means 13, which, see also FIG. 13, are designed to collect the brush semi-finished products 4 from the assembly-shaping line 5, in order to remove them, such as to permit execution of a new operative cycle.

With reference to FIG. 1, going from the right towards the left, the assembly-shaping line 5 comprises: a translator-shaft unit 20, a folder-ring nut unit 21, a ring-holder unit 22, a bristle-cutter unit 23, and a bristle-gripper unit 24.

The translator-shaft unit 20, see in particular FIGS. 1 and 2A, is supported by a first slide 25, which has a lower portion which is connected prismatically to longitudinal guides 26, which are secured to a table 27, and a central portion, which is connected helically to a screw 28, which is actuated by a servomotor 29, for example by means of a helical coupling of the ball-circulation screw type, in order to be able to move the slide 25 axially, by command, and at the required speed of motion and axial thrust, and thus the said translator-shaft unit 20, in both axially opposite directions, as indicated by the arrow F1.

The said translator-shaft unit 20, see in particular FIG. 2A, substantially comprises a cylindrical support 30, which is secured to the first slide 25, inside which there is disposed a tube 31, which is rotably connected such as to rotate with respect to said cylindrical support 30, and the said tube 31 has a length such as to have two opposite ends 32 and 33 which project axially relative to the said cylindrical support 30.

The first end 32 of the said tube 31 supports integrally the lower end of an arm 34, which has an upper forked portion with tines 35*a* and 35*b,* wherein the latter are engaged by a cam 36, which is rotated by means of a servomotor 37 secured to the slide 25, such that when the servomotor 37 is actuated, the said tube 31 is oscillated angularly.

Figures 11, 11A, 11B:
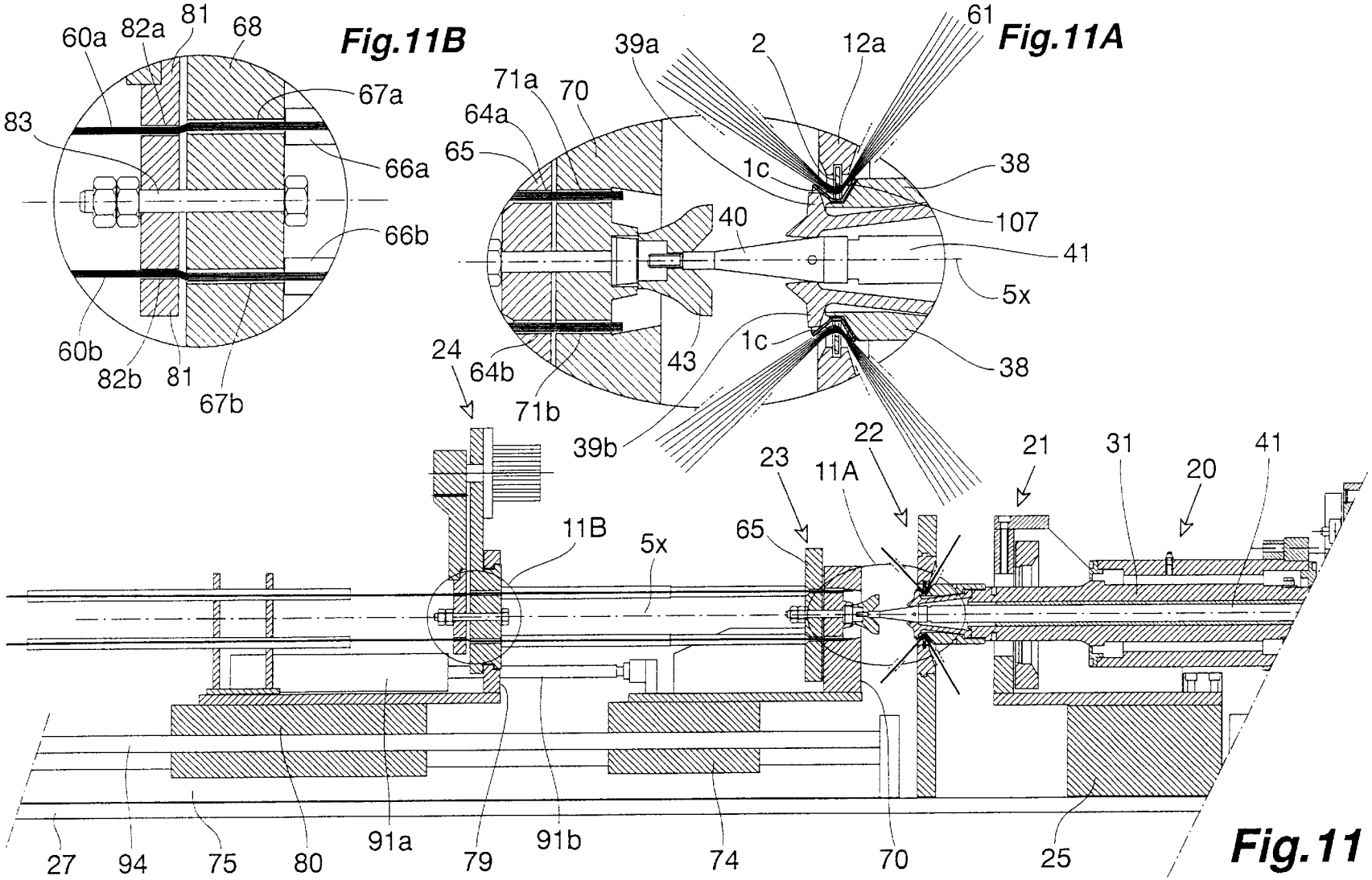
FIG. 11 is a lateral schematic view in cross-section relative to a longitudinal-vertical plane of the machine according to a successive operative step.
FIGS. 11A and 11B are respectively enlarged illustrations of the details 11A and 11B in FIG. 11.

The second end 33 of the said tube 31 has secured to it a hollow shaft-mould 38, inside which there is partially disposed a radially expandable spreader device 39, wherein, see in particular FIGS. 1A, 2A and 2B, the corresponding clamps 39*a*–39*b*–39*c*–39*d*–etc, which are disposed circumferentially equidistantly, are supported by corresponding levers 58*a*–58*b*–etc., which are pivoted at 59*a*–59*b*—etc., inside the said hollow shaft-mold 38, and wherein the said clamps 39*a*–39*b*–39*c*–39*d*—etc., in order to be able to be expanded radially by command, see also FIG. 11A, are engaged by a cone 40, which is secured to the end of a shaft 41 which has a square transverse cross-section, such that the latter is connected prismatically in a sliding manner, axially inside the said tube 31. By means of a rotary coupling 41*a,* the other free end of the said shaft 41 is moved in both axial directions by means of a hydraulic jack 42, which is also secured to the slide 25.

At the free end of the cone 40, there is disposed a conical head 43, which preferably has a curved profiled section, which, see in particular FIG. 1A, can optionally be provided with a plurality of etched longitudinal grooves 44*a*–44*b*–44*c* etc., which are circumferentially equidistant.

With particular reference to the head 43, the clamps 39*a*–39*b*–39*c*—etc., and to the shaft-mould 38, it must be emphasized, for the reasons which will become apparent hereinafter, that these items form a ring nut-holder unit 43-39-38, which is designed to engage the hole 7*b* in the unfinished ring nuts 7, wherein the said ring nut-holder unit 43-39-38 has an outer profiled section which, going from the left towards the right, i.e. from the front towards the rear, has: a first curved conical profiled section 56*a,* provided with longitudinal notches 44, with a maximum diameter which is smaller than the diameter of the hole 7*b* in the ring nut 7, a second cylindrical profiled section 56*b,* which has a diameter smaller than the maximum diameter of the profiled section 56*a,* defining a circumferential groove 56*b* in the said ring nut-holder unit 43-39-38, a third profiled section 56*c,* which has a diameter which is substantially the same as that of the hole 7*b* in the ring nuts 7, and a fourth, diverging conical profiled section 56*d.*

The ring nut-folder unit 21, see also FIGS. 14, 14A, 15 and 15A, substantially comprises a vertical-transverse thrust plate 45, which is provided with a central hole 45*a,* and is rendered integral with the base 27 by means of a horizontal plate 46, and by means of two lateral walls 46*b* which act as a connection plate, only one of which can be seen in the figures.

Figure 14:
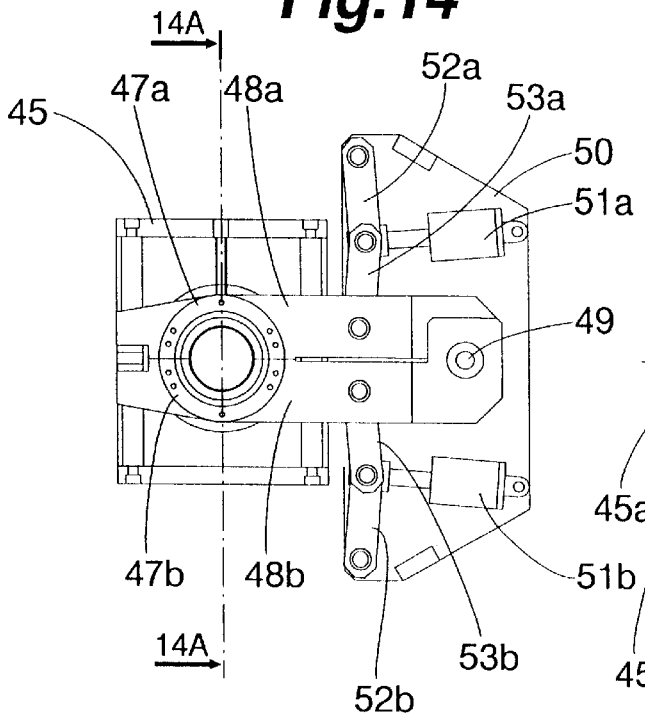
FIGS. 14 and 14A are respectively a front view and a view in cross-section along the line 14A—14A in FIG. 14, of a specific device of the shaping machine in a first operative configuration.
Figure 14A:
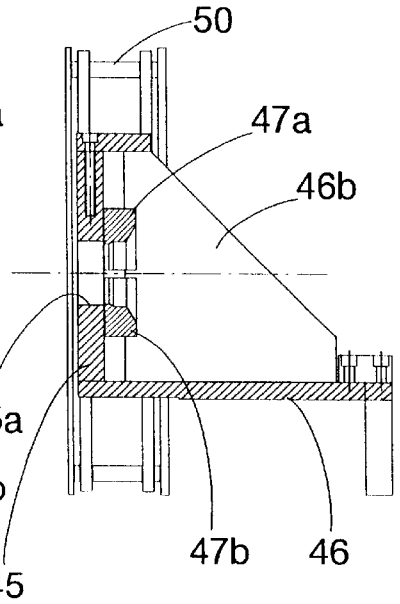
Figure 15:
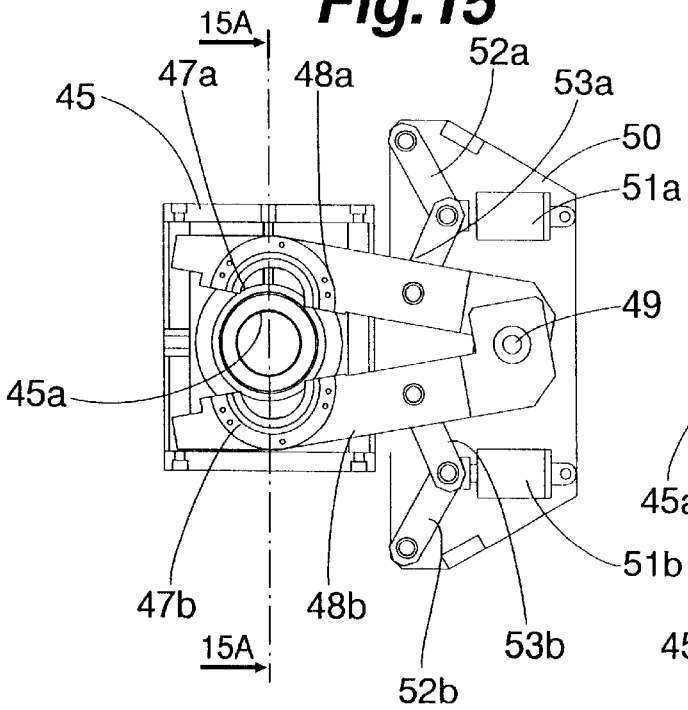
FIGS. 15 and 15A are respectively a front view and a view in cross-section along the line 15A—15A in FIG. 15, of the same aforementioned specific device in a second operative configuration.
Figure 15A:
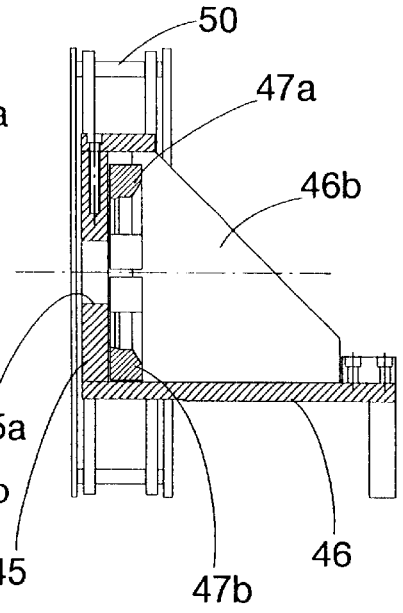

The vertical-transverse plate 45, at the right with reference to the illustrations 14A and 15A, has two half-shells 47*a* and 47*b,* which are disposed such that they abut this vertical-transverse plate 45, and are supported by a corresponding end portion of two corresponding levers 48*a* and 48*b,* which each have their opposite ends pivoted at 49 on a further lateral support 50, which supports in a pivoting manner two fluid-dynamics cylinders 51*a* and 51*b,* which, by means of corresponding articulations 52*a*–53*a* and 52*b*–53*b,* by command, bring close to one another the said two half-shells 47*a* and 47*b,* see FIGS. 14 and 14A, in order to form a matrix 47*a*–47*b,* or, again by command, place the said two half-shells 47*a* and 47*b* in an open position, see FIGS. 15 and 15A, in order to permit free axial advance, through the said open matrix 47*a*–47*b,* and through the hole 45*a,* of the ring nut 7, folded as described in greater detail hereinafter.

With particular reference to the matrix 47*a*–47*b,* it must be emphasized, for the reasons which will become apparent hereinafter, that the latter has an outer profiled section, which, going from left to right, i.e. from the front to the rear, see in particular FIG. 2D, comprises a cylindrical profiled section 60*a,* a conical profiled section 60*b* which diverges towards the rear, and has a maximum diameter which is substantially the same as the outer diameter of the cylindrical portion 7*a* of the ring nut 7, a cylindrical profiled section 60*c* which has a diameter which is slightly larger than the outer diameter of the cylindrical portion 7*a* of the unfinished ring nut 7, and a conical profiled section 60*d* which diverges towards the rear.

Figure 3:
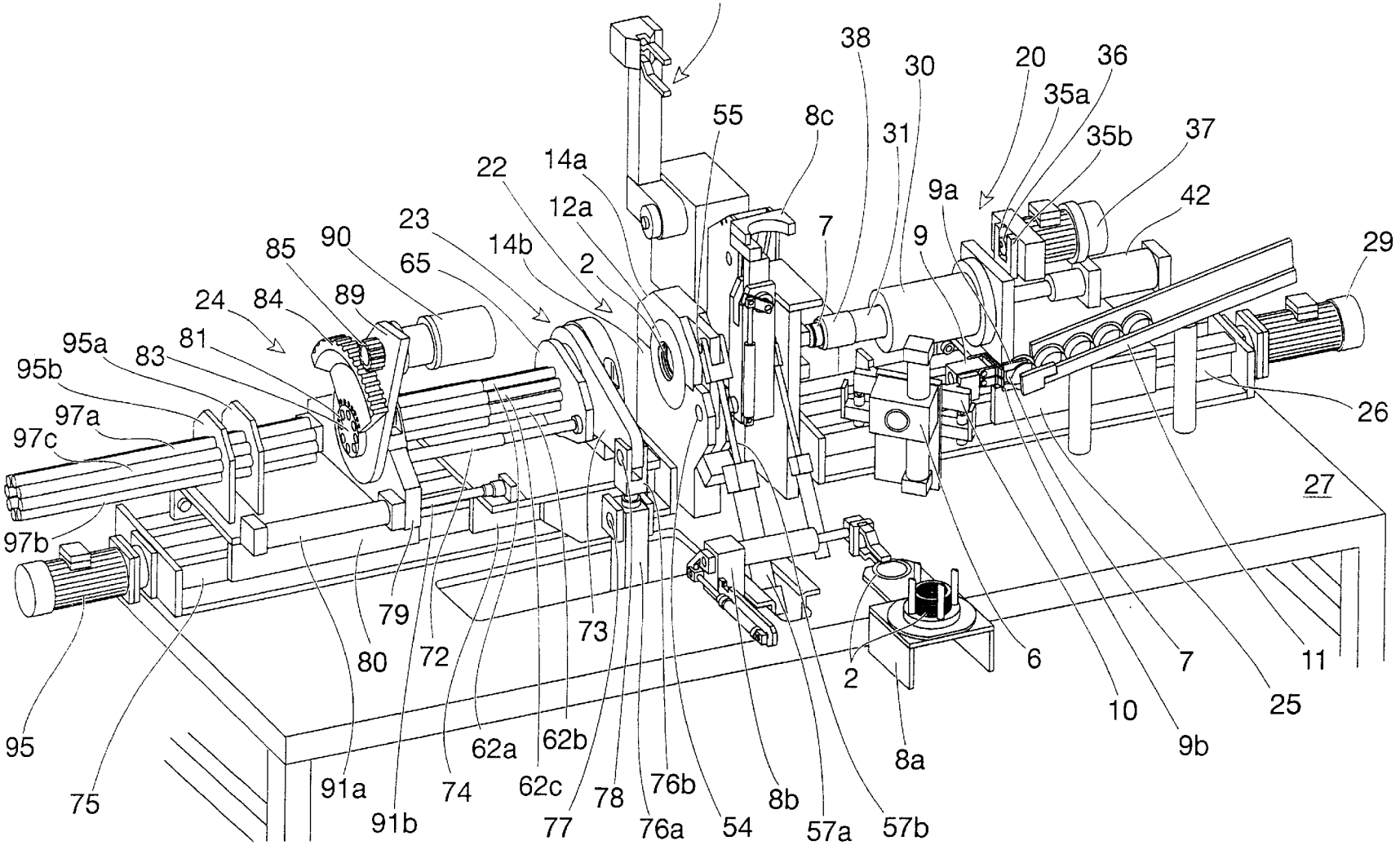
FIG. 3 is a general schematic perspective view of the machine according to a successive operative step.
Figures 3A, 3B, 3C:
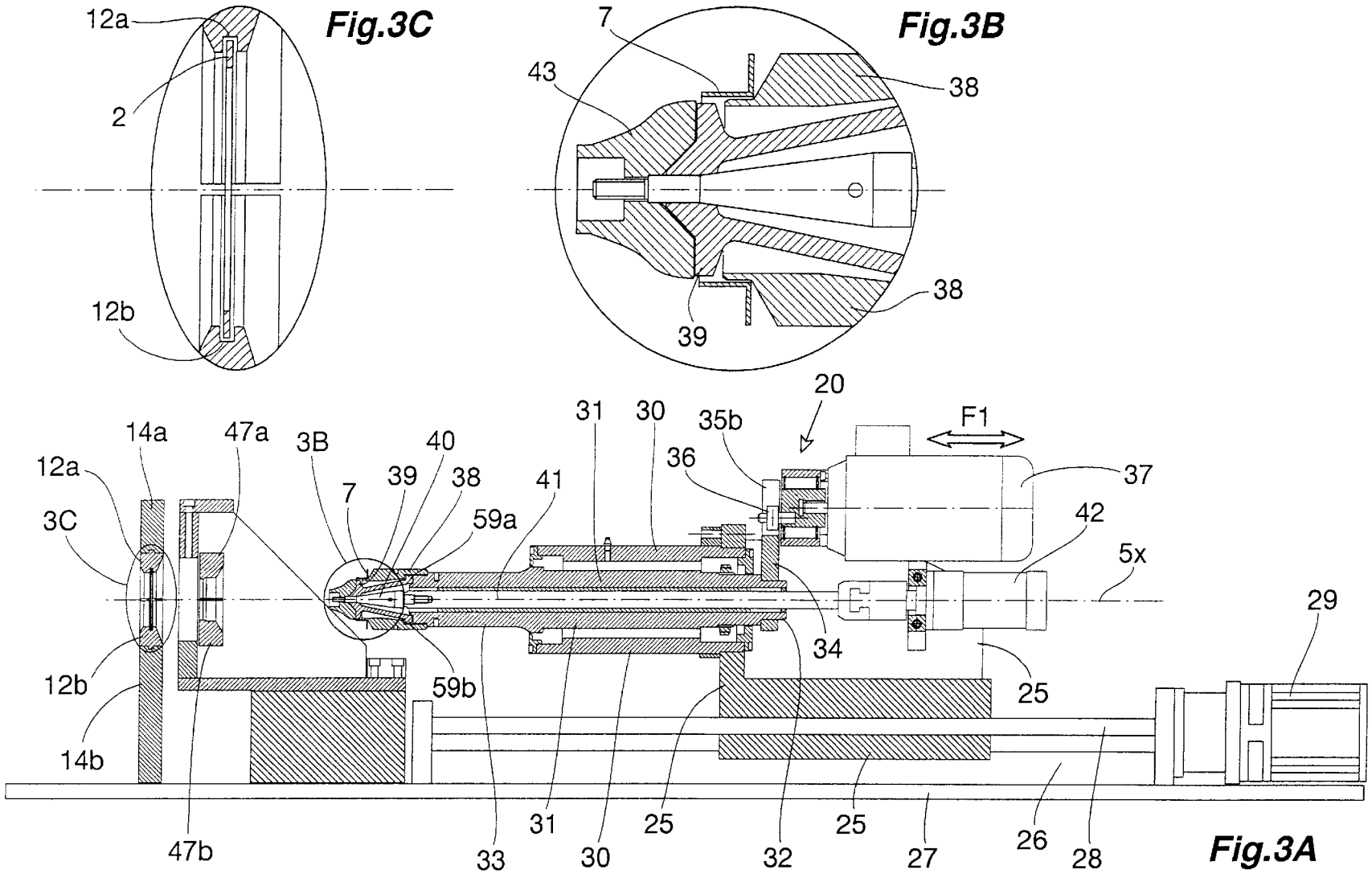
FIG. 3A is a lateral schematic view in cross-section, relative to a longitudinal-vertical plane of the machine in FIG. 3.
FIGS. 3B and 3C are respectively enlarged illustrations of the details 3B and 3C in FIG. 3A.

The ring-holder unit 22, see FIGS. 1, 2E and 2, substantially comprises a lower shell 14*b,* which is secured to the base 27, and is designed to have a lower recess 12*b* for the rings 2, and also the upper half-shell 14*a,* which is designed to have an upper recess 12*a* for the ring 2 as previously described, see also FIGS. 3 and 3C, wherein the said upper half-shell 14*a* is pivoted on the lower shell 14*b* at 54, such that it can be pivoted into the opening or closing position, by command, by means of a jack 57*a*–57*b,* wherein the latter has a cylinder 57*a* which is secured to the base 27, and a rod 57*b* which is pivoted at 55 on the said upper half-shell 14*a*.

By means of this structure, by command, it is possible to put the ring-holder unit 22 into the opening position, see FIGS. 1 and 1C, with the two half-shells 14*a* and 14*b* open, in order to be able to position a ring 2, by means of the ring-supply means 8*a*–8*b*–8*c,* in the recess 12*a,* or, see FIG. 13, in order to be able to collect a circular brush semi-finished product 4 which has the corresponding ring 2 inserted in the recess 12*b,* as described in greater detail hereinafter, by means of the collection-removal means 13, and also, see FIGS. 3 and 3A, to be able to place the ring-holder unit 22 in the closed position, with the two half-shells 14*a* and 14*b* close to one another, such as to hold the ring 2 firmly in the correct position inside the recesses 12*a* and 12*b.*

Figures 10, 10A, 10B:
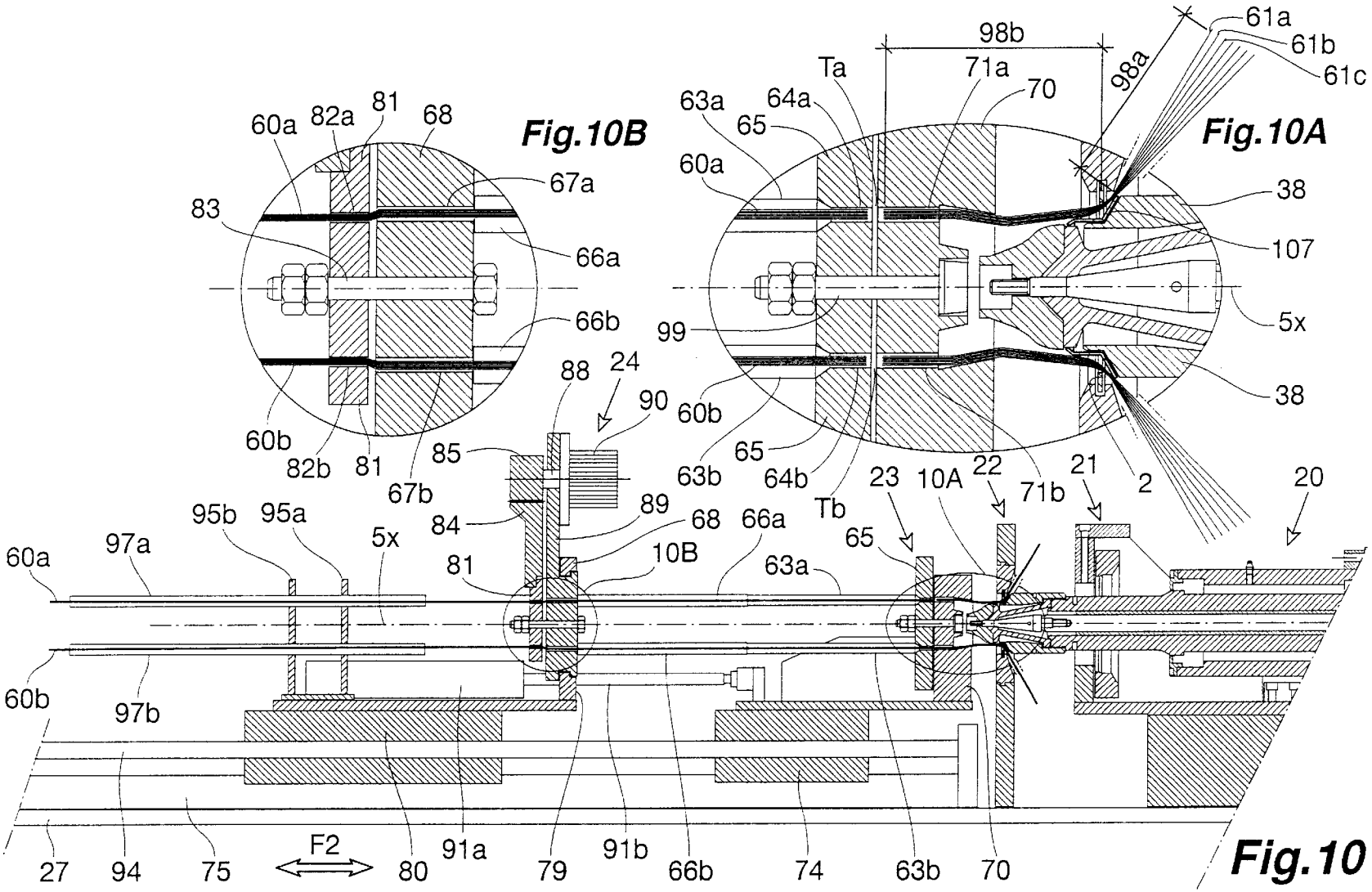
FIG. 10 is a lateral schematic view in cross-section relative to a longitudinal-vertical plane of the machine according to a successive operative step.
FIGS. 10A and 10B are respectively enlarged illustrations of the details 10A and 10B in FIG. 10.

The bristle-cutter unit 23, see also FIGS. 10 and 10A, is designed to cut a plurality of tufts 60*a*–60*b*—etc., and eight tufts in the case illustrated, which are disposed circumferentially equidistantly around an original circumference, such that each tuft, see 60*a,* consists of a mass of bristles 61*a*–61*b*–61*c*—etc., which can be made of plastics and/or metal material, and/or can be of another type.

The tufts 60*a*–60*b*—etc. are contained in a sliding manner inside eight telescopic tubes 62*a*–62*b*—etc., see FIG. 1, which are also disposed circumferentially equidistantly around a single original circumference, wherein the said telescopic tubes 62*a*–62*b*—etc., see FIG. 10A, have first segments 63*a*–63*b*—etc., which have their free end secured at the corresponding eight axial holes 64*a*–64*b*—etc., which are provided in a rotary blade 65 of the bristle-cutter unit 23, and, in an opposite direction, second segments 66*a*–66*b*—etc., which have their free end secured at eight corresponding axial holes 67*a*–67*b*—etc., provided in a first jaw 68 in the bristle-gripper unit 24, which is described in greater detail hereinafter.

The said bristle-cutter unit 23 substantially and schematically comprises the said rotary blade 65, the holes 64*a*–64*b*—etc. which have sharp inner angles in the vicinity of their right end, wherein the said rotary blade 65 is supported such that it can rotate, by means of a pin 99, which is presented by a fixed blade 70 which is disposed adjacent, and is also provided with a corresponding plurality of axial holes 71*a*–71*b*—etc., which have sharp inner angles in the vicinity of their left end, and wherein the said fixed blade 70 is secured onto a second slide 74, which can slide axially, and is connected prismatically onto longitudinal guides 75 which are secured to the base 27.

In addition, see also FIG. 1, the rotary blade 65 has a flange 73, which extends radially on one side, and is engaged by a jack 76*a*–76*b,* which has a cylinder 76*a* pivoted at 77 on the said slide 74, and the free end of a corresponding rod 76*b* pivoted at 78 on the radial end of the said flange 73, such that when the jack 76*a*–76*b* is actuated, i.e. by command, the rotary blade 65 rotates, whereas the blade 70 remains fixed, such that all eight tufts 60*a*–60*b*—etc. of bristles which are engaged in the corresponding eight holes 64*a*–71*a,* 64*b*–71*b* etc, will be cut off, as illustrated at Ta and Tb in FIG. 10A.

The bristle-gripper unit 24, substantially and schematically, see also FIG. 10A, comprises the first jaw 68 which rotates freely, and is also provided with a corresponding number of eight cylindrical holes 67*a*–67*b*—etc., and is rotably connected such as to rotate with respect to a vertical support 79, which is secured to a third slide 80, which also slides axially, and is connected prismatically to the guides 75, which are secured to the base 27.

Adjacent to the said first jaw 68, there is disposed a second jaw 81, which is also provided with a corresponding plurality of eight cylindrical holes 82*a*–82*b*—etc., and is supported such as to rotate by the said first jaw 68, by means of a pin 83, wherein the said second jaw 81 is integral with a toothed segment 84, see also FIG. 1, the toothing of which is engaged with a pinion 85, wherein the latter is supported in a projecting manner by a shaft 88, which is supported such as to rotate by a flange 89, which is integral with the first jaw 68, and wherein the said shaft can be rotated by means of a servomotor 90, preferably of the hydraulic type, which is also secured to the said flange 89.

Figures 9, 9A, 9B:
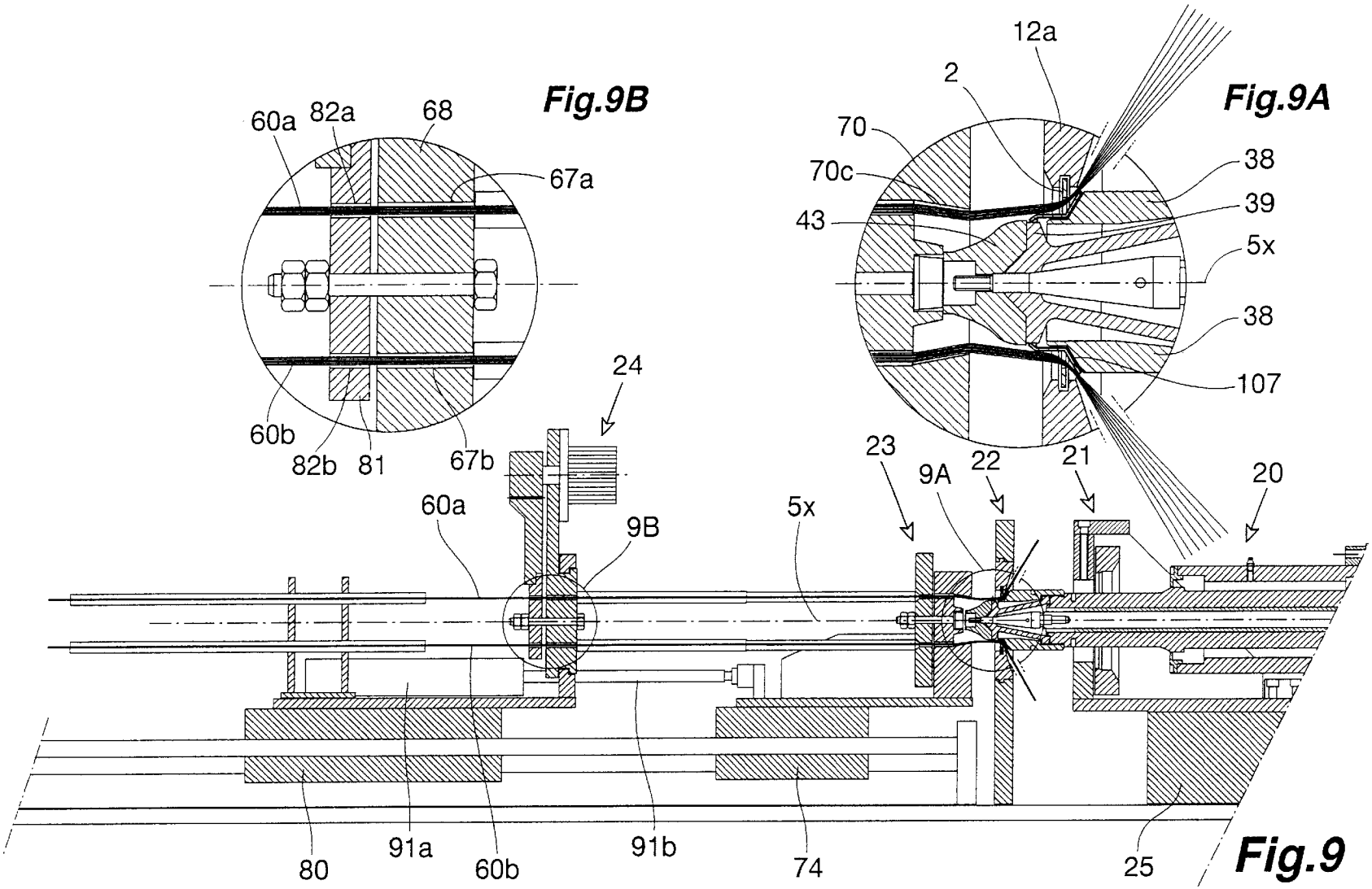
FIG. 9 is a lateral schematic view in cross-section relative to a longitudinal-vertical plane of the machine according to a successive operative step.
FIGS. 9A and 9B are respectively enlarged illustrations of the details 9A and 9B in FIG. 9.

By means of this structuring, by actuating the servomotor 90, see FIG. 10B, it is possible to change the angular position between the said two jaws 81 and 68, as well as to generate and maintain torque between the said two jaws 81 and 68, such as to offset the axial alignment between the holes 82 and 67, and thus to constrict the tufts of bristles 60, in order to inhibit axial sliding of the corresponding bristles 61 relative to the bristle-gripper unit 24, or, on the other hand, see FIG. 9B, to align the holes 82 and 67 axially, in order to allow the tufts 60, and thus the corresponding bristles 61, to slide axially relative to the said bristle-gripper unit 24.

Again with reference to the said bristle-gripper unit 24, see FIG. 1, for the reasons which will become apparent hereinafter, it should be noted that the jaw 68, which rotates freely, is interconnected by means of a telescopic bar 72 to the rotary blade 65, such as to rotate integrally with the latter.

The second slide 74, which is designed to support the bristle-cutter unit 23, and the third slide 80, which is designed to support the bristle-gripper unit 24, are interconnected axially by means of a least one pneumatic jack 91*a*–91*b* (it is also possible to provide a second jack on the opposite side), which acts as a pneumatic spring, wherein the said jack 91*a*–91*b* has a cylinder 91*a* which is rendered integral with the third slide 80, and a rod 91*b,* which is rendered integral with the second slide 74.

In addition, the third slide 80, see in particular FIG. 10, has a portion which is connected helically to a screw 94 which is actuated by a servomotor 95, for example by means of a helical coupling of the ball circulation screw type, in order to be able to move the said bristle-gripper unit 24 axially, by command, at the required speed of motion and axial thrust, in the directions indicated by the arrow F2, and consequently, by means of the pneumatic jack 91*a*–91*b,* the said bristle-cutter unit 23, as described in greater detail hereinafter.

The third slide 80 also supports vertical supports 95*a* and 95*b,* which are designed to support tubes 97*a*–97*b*–97*c*—etc., which are also disposed circumferentially spaced, and are of a number which is equivalent to the number of holes in the bristle-gripper unit 23 and in the bristle-cutter unit 22, wherein the said tubes 97*a*–97*b*–97*c*—etc. encase in a sliding manner the multiple tufts 60*a*–60*b*—etc.

Upstream or to the left of the said tubes 97*a*–97*b*–97*c*—etc., there are disposed devices for shaping and/or supply of the tufts 60*a*–60*b*—etc., which are not described or illustrated here, since they are not included in the inventive concepts of the present invention.

The said machine is also provided with electrical and/or electronic and/or mechanical and/or computerized synchronization means, to manage the control and actuation of the various sensor and actuator means.

Description of Operation

Operation of the assembly-shaping machine which is previously described from a structural point of view, and in particular the operative cycle in order to obtain circular brush semi-finished products 4 in succession, one after the other, consists initially, see FIGS. 1, 1C, 2, 2A, 2C and 2E, of loading the assembly-shaping line 5.

More particularly, this loading, see FIG. 1, consists of collection of an unfinished ring nut 7 from the downstream end of the hopper 11, by means of the gripper 9 with tines 9*a* and 9*b,* and, see FIGS. 2, 2A, 2C, positioning of the unfinished ring nut 7 itself within the said assembly-shaping line 5, by placing the axis 7*x* of the said unfinished ring nut 7 coaxially relative to the axis 5*x* of the assembly-shaping line 5.

In addition, this loading, again see FIG. 1, consists of presentation by the store 8*a* of a ring 2, collection of the latter by the means 8*b,* and translation towards the means 8*c,* grasping of the ring 2 itself by means of the said means 8*c,* and positioning of the ring (see FIG. 1C) inside the upper circular recess 12*a* in the upper half shell 14*a* of the ring-holder means 22, where it is gripped; the positioner 8*c* is then moved away (see FIG. 2), and the upper half-shell 12*a* is then closed by means of actuation of the jack 57*a*–57*b,* and the ring 2 is also placed inside the recess 12*b* in the lower half-shell 14, such as to position the axis 2*x* of the said ring 2 coaxially relative to the axis 5*x* of the assembly-shaping line 5.

Thus, when the loading has taken place, the configuration illustrated in FIG. 2A, and in the corresponding details 2B, 2C, 2D and 2E is obtained.

With reference to FIGS. 3 and 3A, by actuating the servomotor 29, the first slide 25 has been advanced towards the left, with consequent advance of the ring nut-holder unit 43-39-38, which, since it is also coaxial relative to the axis 5*x* of the line 5, optionally with the thrust provided by the conical head 43, is inserted correctly inside the hole 7*b* in the unfinished ring nut 7, which is held in position by the tines 9*a* and 9*b* of the gripper 9, until the configuration illustrated in FIG. 3*b* is obtained, in which the gripper 9 has been returned to its position adjacent to the slide 11, for execution of a successive supply operation, see FIG. 3.

Figures 4, 4A, 4B:
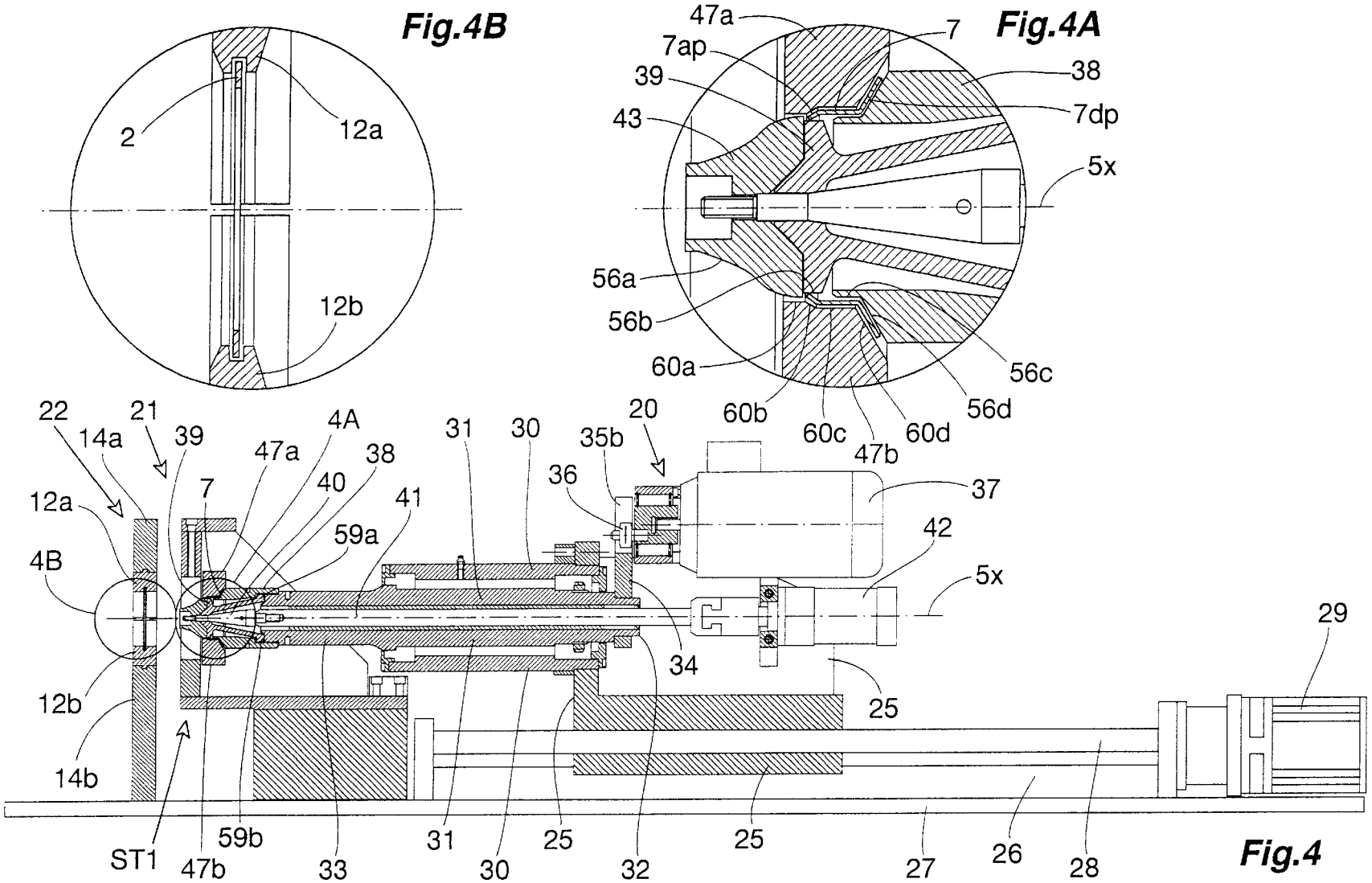
FIG. 4 is a lateral schematic view in cross-section, relative to a longitudinal-vertical plane of the machine according to a successive operative step.
FIGS. 4A and 4B are respectively enlarged illustrations of the details 4A and 4B in FIG. 4.

With reference to FIGS. 4 and 4A, the unfinished ring nut 7 has been advanced further towards the left by the ring nut-holder unit 43-39-38, and into a folding station ST1, in which, more particularly, the said unfinished ring nut 7 has been conveyed against the matrix 47*a*–47*b* of the ring nut-folder unit 21, which has the two half-shells 47*a* and 47*b* in the closing position, and, owing to the profiled sections 60*a*–60*b*–60*c*–60*d* which are present in the said matrix 47*a*–47*b,* and to the profiled sections 56*a*–56*b*–56*c*–56*d* which are present in the said ring nut-holder unit 43-39-38 which acts as a mould, the unfinished ring nut 7 itself undergoes initial folding, which, in the vicinity of its front cylindrical portion 7*a,* is designed to form a conical profiled section 7*ap* which diverges towards the rear, the front head of the said conical profiled section 7*ap* being disposed circumferentially inside the profiled groove 56*b,* and in addition it undergoes second folding, which is designed to fold the perpendicular side 7*d* towards the rear, thus obtaining an inclined side 7*dp,* which provides a folded circular ring nut indicated hereinafter as 107.

Figures 5, 5A, 5B, 5C:
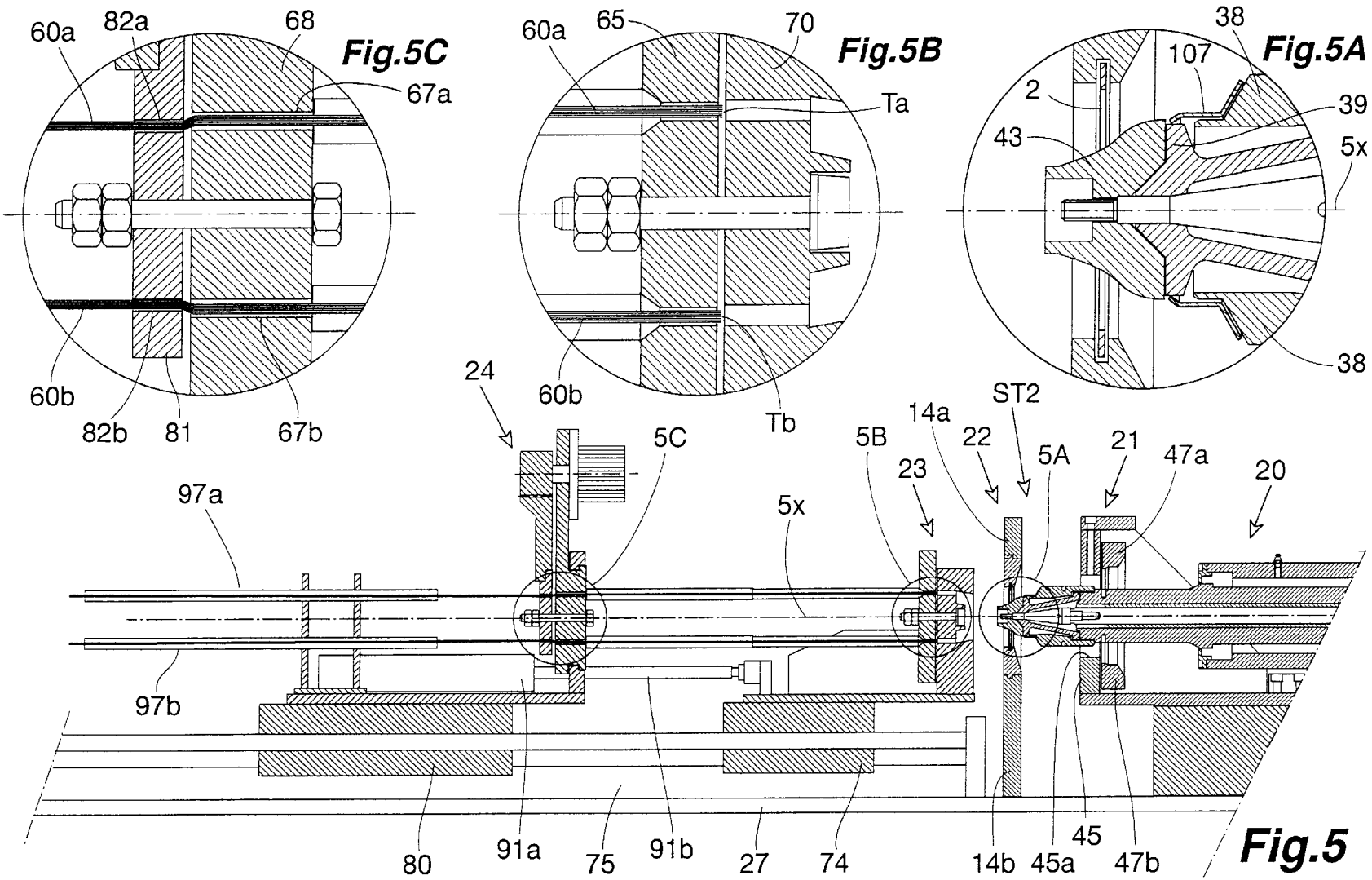
FIG. 5 is a lateral schematic view in cross-section, relative to a longitudinal-vertical plane of the machine according to a successive operative step.
FIGS. 5A, 5B and 5C are respectively enlarged illustrations of the details 5A, 5B and 5C in FIG. 5.

With reference to FIGS. 5 and 5A, by means of actuation of the two fluid-dynamics cylinders 51*a* and 51*b,* see also FIGS. 14 and 15, the two half shells 47*a* and 47*b* have been disposed in the opening position, and, by means of actuation of the servomotor 29, the ring nut-holder unit 43-39-38, together with the corresponding folded circular ring nut 107, has been advanced further towards the left, and, after passing through the hole 45*a* in the vertical-transverse thrust plate 45, has been stopped in a bristle-insertion station, indicated as ST2, in which the head 43 of the ring-nut unit 43-39-38 is partially inserted in the ring 2, which is held in position by the ring-holder unit 22.

Again with reference to FIGS. 5 and 5B, in the operative cycle previously described, as will become more apparent hereinafter, the bristle-cutter unit 23 has cut the continuous tufts 60*a*–60*b*—etc., in the vicinity of the points Ta-Tb-etc., and, also, see FIG. 5C, the two jaws 68 and 81 of the gripper unit 24 have the corresponding holes 82*a*–67*a,* 82*b*–67*b* etc. non-aligned axially with one another, such as to clamp-constrain the tufts 60*a*–60*b*–etc., and thus to inhibit axial sliding of the corresponding bristles 61.

Figures 6, 6A, 6B:
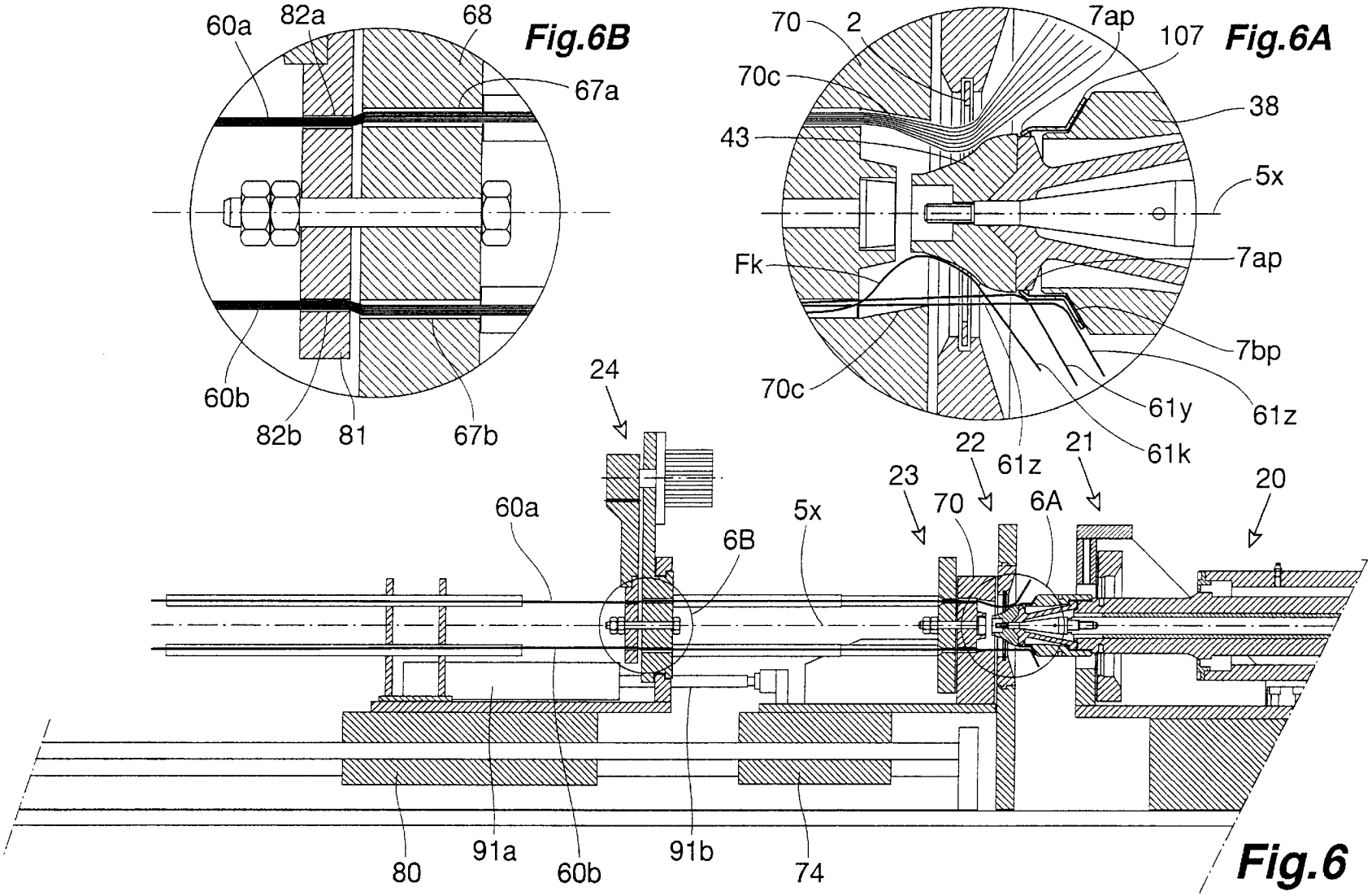
FIG. 6 is a lateral schematic view in cross-section relative to a longitudinal-vertical plane of the machine according to a successive operative step.
FIGS. 6A and 6B are respectively enlarged illustrations of the details 6A and 6B in FIG. 6.

With reference to FIGS. 6, 6A and 6B, whilst maintaining the bristle-gripper unit 24 in the position for clamping of the tufts 60*a*–60*b*—etc., and actuating the servomotor 95, the slide 80 has been advanced towards the ring-holder unit 22, thus also advancing the slide 74 by means of the pneumatic jack 91*a*–91*b,* and during this advance, in sequence, firstly the blade 70 meets the ring-support unit 22, and then, whilst the slide 80 is continuing to advance, and to compress the pneumatic jack 91*a*–91*b* as a result of the corresponding axial movement of approach which is generated between the bristle-gripper unit 24 and the bristle-cutter unit 23, the free ends of the bristles 61 of the tufts 60*a*–60*b*–60*c*—etc. are inserted between the inner diameter of the ring 2 and the outer diameter of the head 43 with a curved profiled section.

More particularly, see FIG. 6A, during this insertion step, the front ends of the bristles 61 of the tufts 60*a*–60*b*—etc. firstly meet a conical surface 70*c* which is presented by the said bristle-cutter unit 23, and arranges the bristles in the shape of a fan, and subsequently, the bristles meet the head 43, and are inserted partially inside the longitudinal notches 44 (see FIG. 1A), and then pass through the gap formed between the inner circumference of the ring 2 and the head 43 itself, and then move towards the folded circular ring nut 107.

Again at least during the said step of insertion of the bristles 61 of the tufts 60*a*–60*b*—etc., the head 43 and the hollow mould-shaft 38, and thus also the folded circular ring nut 107 which is fitted onto the said shaft 38, are made to oscillate angularly relative to the axis 5*x* of the assembly-shaping line 5, by means of actuation of the servomotor 37, which makes the tube 31 oscillate angularly.

With particular reference to FIG. 6A, it must also be pointed out that the front ends of any bristles 61 which project axially against the front head of the ring nut 7 will not be subject to collisions against the said head, since, see for example the bristle 61*y* in FIG. 6A, the front end of the said bristle 61*y* meets the conical profiled section 7*ap* of the folded circular ring nut 107 with an angle of incidence which is not perpendicular, and therefore it will immediately be deflected radially towards the exterior, also as a result of the angular oscillations which the said head 43 and the said folded circular ring nut 107 undergo.

Again in this context, it must be pointed out that the front ends of any other bristles 61 which project axially against the side 7*dp* of the folded ring nut 107 will not be subject to collisions against this side 7*bp,* since, see for example the bristle 61*z* in FIG. 6A, the front end of the said bristle 61*z* meets the conical profiled section 7*dp* of the semi-finished ring nut 107 with an angle of incidence which is not perpendicular, and therefore it will immediately be deflected radially towards the exterior, also as a result of the angular oscillations which the said head 43 and the said folded circular ring nut 107 undergo.

Figures 7, 7A, 7B:
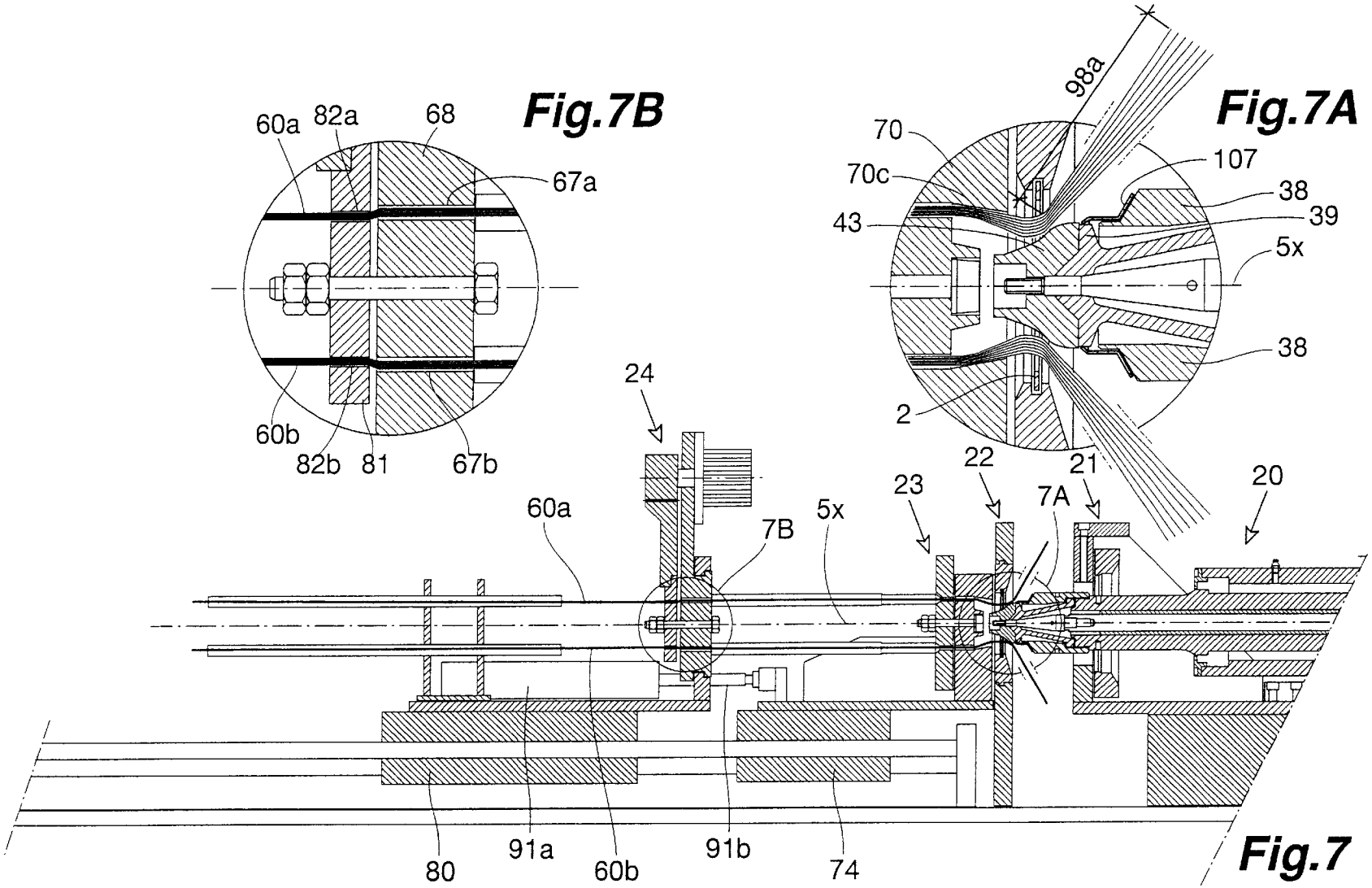
FIG. 7 is a lateral schematic view in cross-section relative to a longitudinal-vertical plane of the machine according to a successive operative step.
FIGS. 7A and 7B are respectively enlarged illustrations of the details 7A and 7B in FIG. 7.

With reference to FIGS. 7, 7A and 7B, by means of actuation of the servomotor 95, the slide 80 has been further advanced towards the right until it stops at a pre-determined point, in order to provide a specific length 98*a* of bristles 61 downstream from the ring 2.

Figures 8, 8A, 8B:
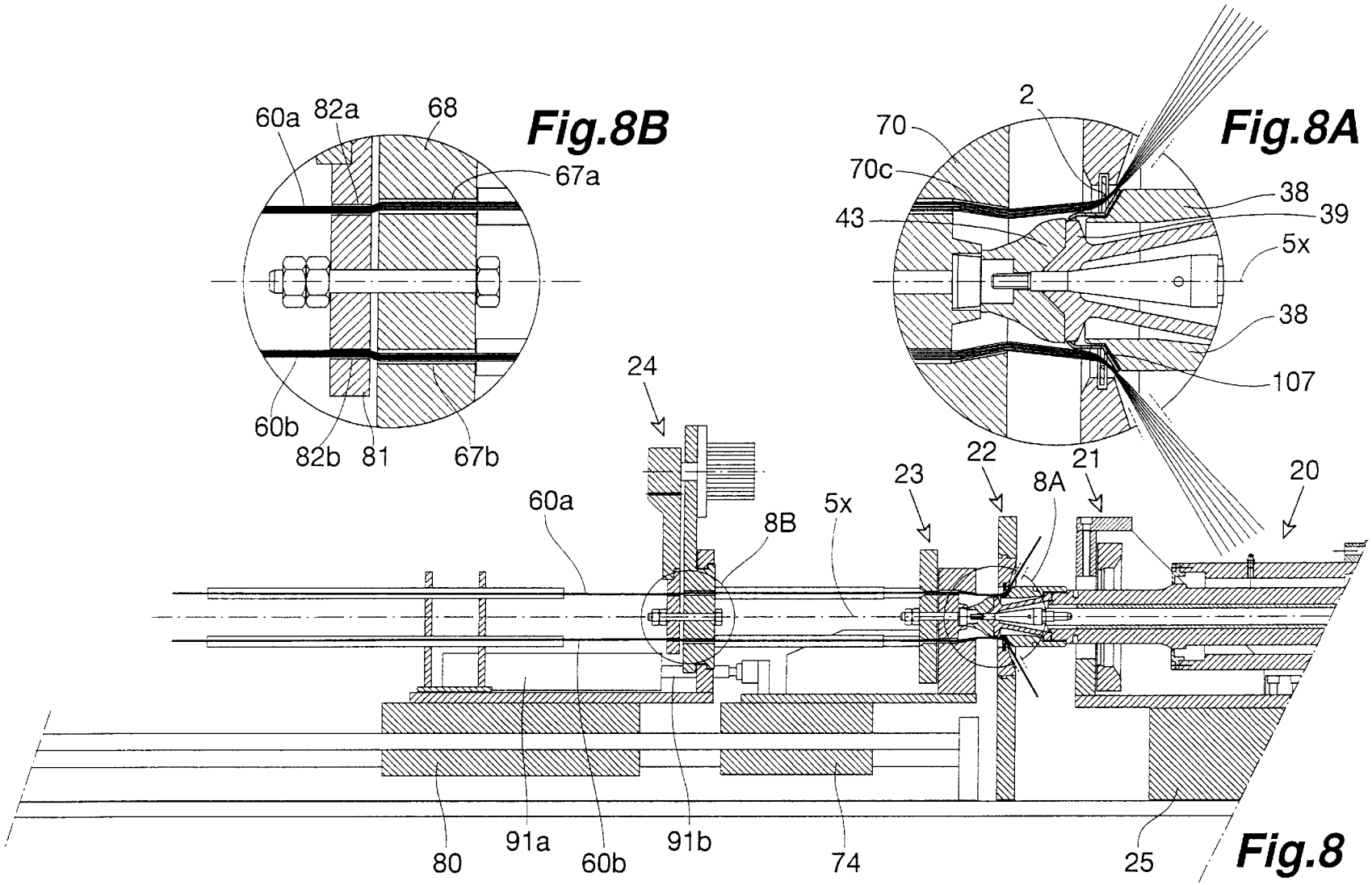
FIG. 8 is a lateral schematic view in cross-section relative to a longitudinal-vertical plane of the machine according to a successive operative step.
FIGS. 8A and 8B are respectively enlarged illustrations of the details 8A and 8B in FIG. 8.

With reference to FIGS. 8, 8A and 8B, after having inserted the required length 98*a* of bristles, whilst keeping the bristle-gripper unit 23 in the clamping position, by means of actuation of the servomotor 29, the slide 25 and the corresponding translator-shaft unit 20 which supports the ring nut-holder unit 43-39-38, have been advanced towards the said ring 2, until the bristles 61*a*–61*b*–61*c*—etc are gripped between the inner diameter of the said ring 2 and the ring nut 107, with an intensity which inhibits axial sliding of the bristles.

With reference to the aforementioned phase which is designed to obtained a specific length 98*a* of bristles 61 downstream from the said ring 2, in the case of particular types of bristles, it may happen that some bristles, see for example the bristle 61*k* illustrated in FIG. 6A, during insertion, which is obtained by applying axial thrust at a point upstream from the said bristle 61*k,* i.e. between the two jaws 81-68, undergo excessive abnormal flexure Fk, such that the portion of bristle 61*k* which is disposed downstream from the ring 2 is shorter than the required length 98*a,* and than the length of the other bristles 61.

In order to eliminate this disadvantage, if necessary, the bristle-gripper unit 24 is advanced towards the said ring 2, until there is obtained downstream from the said ring 2 a portion of bristles which have a length longer than the required length 98*a,* and subsequently, the bristle-gripper unit 24 is withdrawn in relation to the said ring 2, i.e. axial traction is applied on the bristles 61, until the required length 98*a* of bristles 61 is obtained downstream from the said ring 2.

By this means, any incorrect flexure Fk of the bristle 61*k* which took place during the first, axial thrust phase is eliminated during the second, axial traction phase, wherein the said latter phase is designed to determine the required length 98*a* of bristles disposed downstream from the said ring 2. The said second phase, again if necessary, can also be carried out after the ring nut 107 and the ring 2 have been brought close to one another.

With reference to FIGS. 9, 9A and 9B, after the bristles have been gripped between the ring 2 and the folded ring nut 107, by command, by actuating the servomotor 90, the bristle-gripper unit 23 has been placed in the opening position, i.e. with the holes 82*a*–67*a,* 82*b*–67*b* etc aligned axially, in order to obtain release of the various tufts 60*a*–60*b*—etc., which can now slide freely through the said bristle-gripper unit 24, and therefore move the slide 80 towards the left by actuating the servomotor 95, obtaining initially displacement towards the left of the bristle-gripper unit 24, with extension of the jack 91*a*–91*b,* and, when the latter is just in the vicinity of its end of travel, withdrawal of the slide 74, and therefore of the corresponding bristle-cutter unit 23, whereas the tufts 60*a*–60*b*—etc. of bristles 61 have continued to be at a standstill and stationary, since they are gripped between the ring 2 and the folded ring nut 107.

With reference to FIGS. 10, 10A and 10B, when the slide 80 has reached a pre-determined axial position in which, preferably, the length of the bristles 61 which is upstream from the ring 2, and is indicated as 98*b,* is the same as the preceding length 98*a* of the same bristles 61 disposed downstream from the ring 2, i.e. in which, substantially, a required distance has been reached between the cutting point Ta-Tb-etc. of the bristle-cutter unit 23 and the ring 2, firstly the servomotor 95 has been stopped, and the bristle-gripper unit 23 has been placed in the clamping position, and then, by means of actuation of the jack 76*a*–76*b,* the rotary blade 65 has been rotated, with consequent cutting of the bristles 61*a*–61*b*–61*c*—etc. of each tuft 60*a*–60*b*—etc., at the points Ta-Tb-etc., i.e. at the required point.

In this context, in the particular practical embodiment described, in which eight tufts/holes are provided, the said tufts 60*a*–60*b*—etc. are cut by means of angular rotation by 45° of the rotary blade 65, which is equivalent to the angular distance between two adjacent circumferential holes/tufts, such that when the cutting is completed, the holes 64*a*–64*b*—etc., in the rotary blade 65 will once more be aligned axially with the holes 71*a*–71*b*—etc. in the fixed blade 70, but offset by one angular step relative to the original position.

In addition, for the reasons which will become apparent hereinafter, owing to the telescopic bar 72 which interconnects the rotary blade 65 and the jaw 68, the said rotation by 45° of the rotary blade 65 gives rise to rotation by 45° of the bristle-gripper unit 24, and more particularly of the assembly formed by the jaw 68, the flange 89, the motor 90, the pinion 85, the segment 84, and the other jaw 81.

With reference to FIGS. 11, 11A and 11B, by means of actuation of the jack 42, the shaft 41 and the corresponding associated cone 40 have been displaced towards the left, and the said cone 40, by acting on the jaws 39*a*–39*b*–39*c*—etc., has expanded the latter radially towards the exterior, with consequent radial folding towards the exterior of the front edge 7*ap*–7*a* of the ring nut 107, and corresponding shaping of the side 1*c,* thus providing the semi-finished product indicated as 4 in FIGS. 16 and 16A.

Figures 12, 12A, 12B:
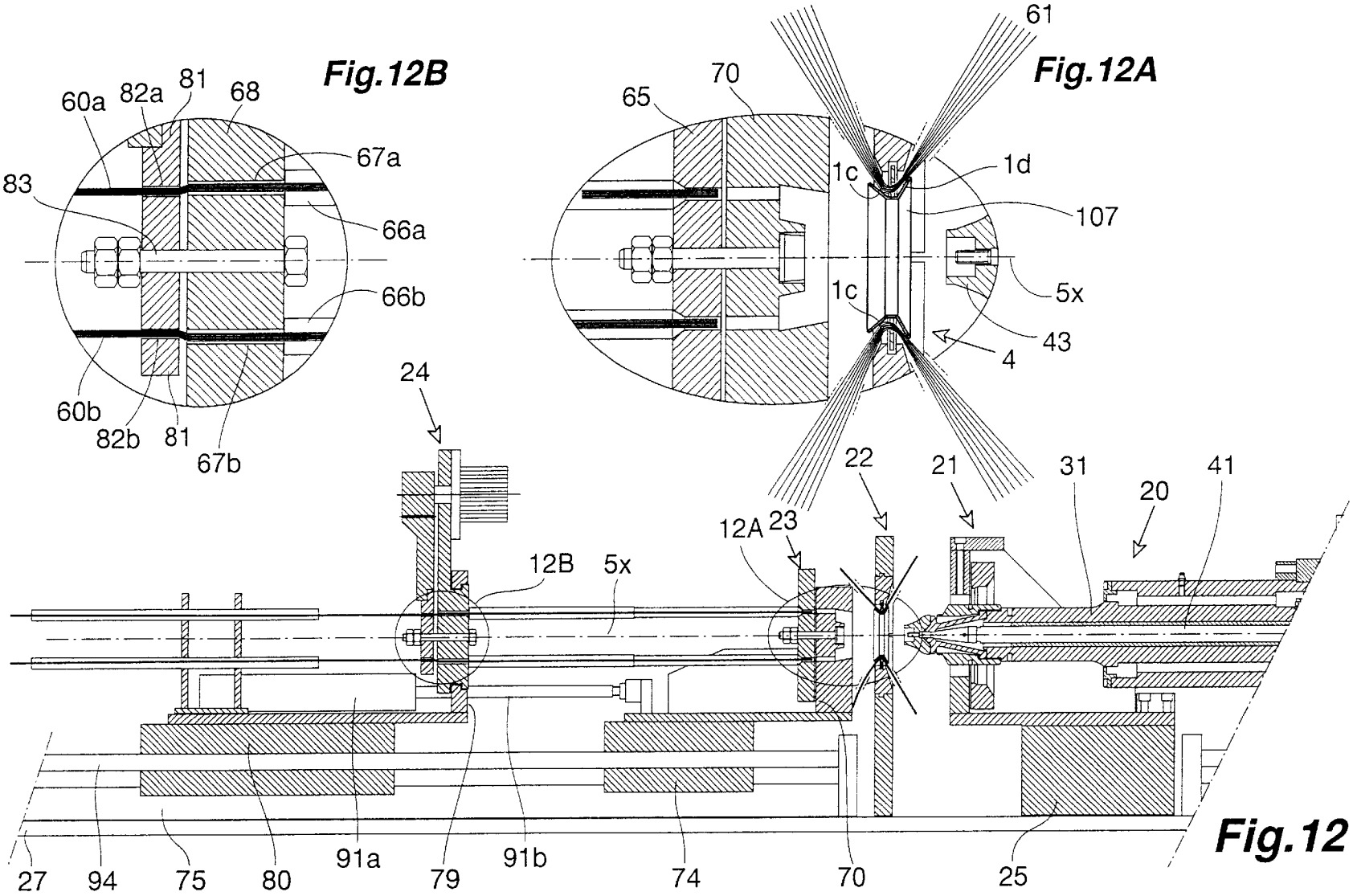
FIG. 12 is a lateral schematic view in cross-section relative to a longitudinal-vertical plane of the machine according to a successive operative step.
FIGS. 12A and 12B are respectively enlarged illustrations of the details 12A and 12B in FIG. 12.

With reference to FIGS. 12, 12A and 12B, after the aforementioned shaping has taken place, the shaft 41 has been returned to its original position, and, by actuating the servomotor 29, the slide 25, and thus the corresponding translator-shaft unit 20, have been displaced towards the right, whereas the semi-finished product 4 has remained fixed, since the ring 2 is clamped in the ring-holder unit 22.

Finally, with reference to FIG. 13, after the upper half-shell 14*a* of the ring-holder means 22 has been opened, the collection means 13 have collected the circular brush semi-finished product 4, and have then removed it in order to be able to carry out a new operative cycle.

The new operative cycle will substantially be similar to the previous one, and the only difference consists in the fact that, in order to cut the bristles, i.e. in order to carry out the operation illustrated in FIG. 10, the rotary blade 65 is rotated in the opposite direction, again by 45°, thus, again owing to the telescopic interconnection bar 72, obtaining rotation by 45° of the bristle-gripper unit 24, in a direction opposite to that in the previous case, thus obtaining once again the configuration in FIG. 9.

The preceding description of the system and of the corresponding assembly-shaping machine is provided purely by way of non-limiting example, and it is thus apparent that all modifications and/or variants suggested by practice and by utilization and use can be made to this system and machine, within the context of the scope of the following claims.

What is claimed is:

1. A method for assembling and shaping circular brush semi-finished products along an assembly line, in which each semi-finished product comprises:

a circular ring nut having an axis; a first circumferential side, a substantially cylindrical central portion, a second circumferential side, and a central axial hole, wherein the said two circumferential sides form a circumferential channel of a "U" section;

a ring disposed between the said two sides of the said finished ring nut, and disposed coaxial with the ring nut; and a plurality of bristles which are distributed circumferentially and project radially outwardly and are disposed in the shape of a "V", with a vertex inside the said "U"-section channel, and with the ring disposed in the vertex of the "V";

said method comprising the steps of:

(a) providing a folded circular ring nut, which extends axially along a respective ring axis and has a conical front profiled section which diverges towards a rear direction, a central cylindrical portion, an inclined rear circumferential side which diverges towards the rear direction, and a central axial hole fitted onto a ring nut-holder unit with a conical front head, the axis of the said ring nut being disposed coaxially with said assembly line;

(b) disposing said ring slightly in front of said folded ring nut and coaxially therewith; and (c) inserting a plurality of bristles in a circumferentially distributed manner between the inner circumference of the said ring and an outer circumference of the said head, and thus on the outer circumference of the said folded circular ring nut, until a specific length of bristles is obtained downstream from the said ring.

2. The method defined in claim 1 wherein, after step (c), the following steps are carried out:

(d) pressing the folded circular ring nut axially against the ring, in order to inhibit axial sliding of the bristles between the ring and the ring nut;

(e) the plurality of continuous bristles is cut at a point upstream from the ring in order to obtain a specific length of bristles disposed upstream from the said ring; and (f) a front portion of the folded ring nut is expanded radially in order to form a further side.

3. The method defined in claim 2, further comprising the step of oscillating the said head angularly about an axis of the head in step (c).

4. The method defined in claim 2, further comprising the step, at least during step (c), of oscillating the ring nut angularly about its axis.

5. The method defined in claim 2 wherein in step (c):

c1) the bristles are thrust axially towards the ring and towards the said folded circular ring nut, until a length of bristles which is longer than the required length is obtained downstream from the said ring; and c2)-axial traction is exerted on the bristles, until the required length of bristles is obtained downstream from the said ring.

6. The method defined in claim 2 wherein before the bristle insertion an unfinished circular ring nut, which extends axially along its own axis, and has a cylindrical front portion, a rear circumferential side and a central axial hole is fitted onto a ring nut-holder unit which has a shaft-mold, such as to dispose the axis of the said unfinished ring nut coaxially relative to an axis of the said assembly line;

there is provided a circular matrix, which extends along its own axis, in front of the said unfinished ring nut, and an axis of the said circular matrix is disposed coaxially relative to the axis of the said assembly line, and thus coaxially relative to the axis of the said unfinished ring nut;

the said unfinished ring nut is deformed by being pressed between the said shaft-mold and the said matrix, in order to obtain a folded circular ring nut which has a front conical profiled section which diverges towards the rear, and an inclined rear circumferential side which diverges towards the rear.

7. The method defined in claim 6 wherein the said matrix comprises two half-shells, which are mobile in a vertical-transverse plane, such that they can be placed in a first position, of closure, in which the said two half-shells form a circular matrix which has its axis disposed coaxially relative to the axis of the line, and in a second position, of opening, in which the said two half-shells are open in order to permit free passage of the semi-finished ring nut through the latter.

8. The method defined in claim 7 wherein on the side opposite the thrust side of the said matrix there is disposed a vertical-transverse thrust plate, which is provided with a central hole, an axis of which is coaxial relative to the axis of the said line, and the diameter of which is larger than the maximum diameter of the semi-finished ring nut.

9. The method defined in claim 2 wherein from the front towards the rear, the ring nut-holder unit has the conical head, which is designed to guide the bristles during insertion of the latter, a radial spreader device, which is designed to expand radially the front portion of the folded ring nut, and a shaft-mold, which is designed to fold the unfinished ring nut.

10. The method defined in claim 2 wherein from the front towards the rear, the ring nut-holder unit has a front conical profiled section, which has a maximum diameter smaller than the diameter of the hole in the ring nut, a second profiled section, which has a diameter smaller than the maximum diameter of the preceding conical profiled section, defining a circumferential groove in the said ring nut-holder unit, a third profiled section, which has a diameter which is substantially the same as that of the hole in the ring nuts, and a rear conical profiled section which diverges towards the rear.

11. The method defined in claim 10 wherein the front conical profiled section of said ring nut, which diverges towards the rear of the folded circular ring nut, is disposed circumferentially inside the circumferential groove provided by the said ring nut-holder unit.

12. The method defined in claim 1 wherein the conical head has a plurality of longitudinal notches disposed circumferentially and receiving said bristles.

13. A machine for making brush units wherein ring nuts receive bristles which are held in place by respective rings, said machine comprising:

an assembly line (5) which extends axially along its own axis (5*x*), and includes:

a translator-shaft unit (20), which is mobile axially by command, supports and translates axially along the said axis (5*x*) of the said assembly line (5) a ring nut-holder unit (43-39-38), which, going from the front towards the rear, has a conical head (43), a radial spreader device (39) and a shaft (38);

a ring nut-folder unit (21), is provided with a circular matrix (47*a*–47*b*), which extends axially along its own axis (47*x*), coaxially relative to the axis (5*x*) of the said assembly line (5), and can fold an unfinished circular ring nut (7), in order to obtain a conical profiled section (7*ap*) which diverges towards the rear, in the vicinity of its front head, and an inclined profiled section (7*dp*), which also diverges towards the rear of the circumferential side (7*d*);

a ring-holder unit (22), which is designed to hold in position a ring (2), with the corresponding axis (2*x*) coaxially relative to the axis (5*x*) of the said line (5);

a bristle-cutter unit (23), which is mobile axially by command, and is designed to cut a plurality of tufts (60) of continuous bristles (61), which are disposed upstream from the said ring (2); and a bristle-gripper unit (24), which is mobile axially by command, and is designed to move the said bristles (61) axially relative to the said ring (2).

14. The machine defined in claim 13, wherein the said translator-shaft unit (20) is supported by a slide (25), which has a lower portion which is connected to longitudinal guides (26), which are secured to a table (27) of the machine, and a central portion, which is connected helically to a screw (28), which is actuated by a servomotor (29).

15. The machine defined in claim 13, wherein the said bristle-gripper unit (24) is supported by a first slide (80), which has a lower portion which is connected to longitudinal guides (75), which are secured to a table (27) of the machine, and a central portion, which is connected helically to a screw (94), which is actuated by a servomotor (95).

16. The machine defined in claim 15, wherein the bristle-cutter unit (23) is supported by a second slide (74), which has a lower portion which is connected to longitudinal guides (75), which are secured to a table (27) of the machine, and in that the said second slide (74) is interconnected axially to the said first slide (80), which is designed to support the bristle-gripper unit (24) by means of a jack (91*a*–91*b*).

17. The machine defined in claim 13, wherein the said bristle-gripper unit (24) comprises:

a vertical support (79);

a first jaw (68), which is provided with a plurality of axial holes (67*a*–67*b*—etc.), disposed circumferentially, which is rotatably connected such as to rotate with respect to said vertical support (79);

a second jaw (81), which is disposed adjacent to the said first jaw (68), and is also provided with a corresponding plurality of axial holes (82*a*–82*b*—etc.) disposed circumferentially, and is supported such as to rotate by the said first jaw (68) by means of a rotation pin (83);

a toothed segment (84), which is integral with the said second jaw (81), and is designed to move the said first jaw (68) angularly relative to the said rotation pin (83); and a pinion (85), which is engaged on the said circular segment (84), supported by a flange (89) which is integral with the first jaw (68), and is actuated by means of a servomotor (90) which is also secured to the said flange (89).

18. The machine defined in claim 17 wherein said bristle-gripper unit (24) has the first jaw (68) interconnected by means of a telescopic bar (72) to a rotary blade (65) of the bristle-cutter unit (24), such that the rotations of the said rotary blade (65) give rise to rotation of the assembly formed by the first jaw (68), the flange (89), the motor (90), the pinion (85), the segment (84) and the second jaw (81).

* * * * *